US007557072B2

(12) United States Patent
Fütterer et al.

(10) Patent No.: US 7,557,072 B2
(45) **Date of Patent: *Jul. 7, 2009**

(54) DETERGENT COMPOSITION WITH HYDROPHILIZING SOIL-RELEASE AGENT AND METHODS FOR USING SAME

(75) Inventors: Tobias Johannes Fütterer, Singapore (SG); Lawrence Alan Hough, Philadelphia, PA (US); Robert Lee Reierson, Princeton Junction, NJ (US)

(73) Assignee: Rhodia Inc., Cranbury, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/138,030

(22) Filed: Jun. 12, 2008

(65) Prior Publication Data

US 2008/0312120 A1 Dec. 18, 2008

Related U.S. Application Data

(60) Provisional application No. 60/943,479, filed on Jun. 12, 2007.

(51) Int. Cl.
*C11D 1/72* (2006.01)
*C11D 7/36* (2006.01)
*C11D 3/37* (2006.01)

(52) U.S. Cl. ..... 510/136; 510/130; 510/131; 510/150; 510/228; 510/236; 510/288; 510/319; 510/347; 510/390; 510/423; 510/431; 510/436; 510/467

(58) Field of Classification Search ..... 510/136, 510/130, 131, 150, 228, 236, 288, 319, 347, 510/390, 423, 431, 436, 467
See application file for complete search history.

(56) References Cited

U.S. PATENT DOCUMENTS

| | | | | |
|---|---|---|---|---|
| 2,438,091 | A | | 3/1948 | Lynch |
| 2,524,218 | A | | 10/1950 | Bersworth |
| 2,528,378 | A | | 10/1950 | Mannheimer |
| 2,530,147 | A | | 11/1950 | Bersworth |
| 2,658,072 | A | | 11/1953 | Kosmin |
| 2,826,551 | A | | 3/1958 | Geen |
| 2,874,074 | A | | 2/1959 | Johnson |
| 2,946,725 | A | | 7/1960 | Norris et al. |
| 3,033,704 | A | | 5/1962 | Sherrill et al. |
| 3,070,510 | A | | 12/1962 | Cooley et al. |
| 3,244,724 | A | | 4/1966 | Guttmann |
| 3,308,067 | A | | 3/1967 | Diehl |
| 3,332,880 | A | | 7/1967 | Kessler et al. |
| 3,538,230 | A | | 11/1970 | Pader et al. |
| 3,553,139 | A | | 1/1971 | McCarty |
| 3,598,865 | A | | 8/1971 | Lew |
| 3,599,716 | A | | 8/1971 | Thompson |
| 3,678,154 | A | | 7/1972 | Widder et al. |
| 3,681,241 | A | | 8/1972 | Rudy |
| 3,717,630 | A | | 2/1973 | Booth |
| 3,723,322 | A | | 3/1973 | Diehl |
| 3,793,209 | A | | 2/1974 | Thompson |
| 3,850,831 | A | * | 11/1974 | Hellsten et al. ..... 510/371 |
| 3,862,307 | A | | 1/1975 | Di Giulio |
| 3,869,412 | A | * | 3/1975 | Waag ..... 510/467 |
| 3,893,929 | A | | 7/1975 | Basadur |
| 3,912,681 | A | | 10/1975 | Dickson |
| 3,939,911 | A | | 2/1976 | Maddox, Jr. et al. |
| 3,948,838 | A | | 4/1976 | Hinton, Jr. et al. |
| 3,956,198 | A | | 5/1976 | Bauer |
| 3,959,230 | A | | 5/1976 | Hays |
| 3,959,458 | A | | 5/1976 | Agricola et al. |
| 3,964,500 | A | | 6/1976 | Drakoff |
| 3,976,586 | A | | 8/1976 | Chakrabarti |
| 4,001,133 | A | | 1/1977 | Sorgenfrei et al. |
| 4,008,165 | A | | 2/1977 | Maddox, Jr. et al. |
| 4,017,410 | A | | 4/1977 | Sorgenfrei et al. |
| 4,038,027 | A | | 7/1977 | Kearney |
| 4,049,558 | A | | 9/1977 | Rasmussen |
| 4,051,234 | A | | 9/1977 | Gieske et al. |
| 4,101,457 | A | | 7/1978 | Place et al. |
| 4,116,984 | A | | 9/1978 | Prinzbach et al. |

(Continued)

FOREIGN PATENT DOCUMENTS

| | | |
|---|---|---|
| DE | 2829022 | 1/1980 |

(Continued)

OTHER PUBLICATIONS

U.S. Appl. No. 12/137,589 "Mono-, Di- and Polyol Phosphate Esters in Personal Care Formulations", Futterer et al., filed Jun. 12, 2008.

(Continued)

*Primary Examiner*—Charles I Boyer
(74) *Attorney, Agent, or Firm*—Novak Druce + Quigg LLP

(57) ABSTRACT

Laundry detergent compositions that provide soil release benefits to all fabric comprising an organophosphorus soil release agents and optional non-cotton secondary soil release agents. The present invention further relates to a method for providing soil release benefits to cotton fabric by contacting cotton articles with a water soluble and/or dispersible organophosphorus material. The contacting can be during washing or by pretreating by applying the composition directly to stains or by presoaking the clothing in the composition prior to washing. The present invention further relates to providing soil release benefits to all fabric in the laundry wash load in the presence of a bleaching agent.

10 Claims, 1 Drawing Sheet

U.S. PATENT DOCUMENTS 4,127,489 A 11/1978 Pracht et al.
4,144,226 A 3/1979 Crutchfield et al.
4,146,495 A 3/1979 Crutchfield et al.
4,152,416 A 5/1979 Spitzer et al.
4,152,421 A 5/1979 Tsutsumi et al.
4,206,215 A 6/1980 Bailey
4,235,735 A 11/1980 Marco et al.
4,240,919 A 12/1980 Chapman
4,261,868 A 4/1981 Hora et al.
4,264,580 A 4/1981 Barberio
4,278,129 A 7/1981 Walton
4,287,080 A 9/1981 Siklosi
4,321,256 A 3/1982 Hasegawa et al.
4,350,680 A 9/1982 Harvey et al.
4,364,837 A 12/1982 Pader
4,391,722 A * 7/1983 Schwartz et al. ..... 252/73
4,393,935 A 7/1983 Walton
4,470,923 A 9/1984 Koster
4,483,779 A 11/1984 Llenado et al.
4,507,219 A 3/1985 Hughes
4,525,291 A * 6/1985 Smith et al. ..... 510/303
4,536,317 A 8/1985 Llenado et al.
4,536,318 A 8/1985 Cook et al.
4,536,319 A 8/1985 Payne
4,541,483 A 9/1985 Walton
4,548,744 A 10/1985 Connor
4,557,853 A 12/1985 Collins
4,559,056 A 12/1985 Leigh et al.
4,565,647 A 1/1986 Llenado
4,579,681 A 4/1986 Ruppert et al.
4,597,898 A 7/1986 Vander Meer
4,599,188 A 7/1986 Llenado
4,614,519 A 9/1986 Ruppert et al.
4,627,977 A 12/1986 Gaffar et al.
4,664,839 A 5/1987 Rieck
4,702,857 A 10/1987 Gosselink
4,711,730 A 12/1987 Gosselink et al.
4,721,580 A 1/1988 Gosselink
4,728,455 A 3/1988 Rerek
4,734,099 A 3/1988 Cyprien
4,746,456 A 5/1988 Kud et al.
4,752,409 A 6/1988 Drapier et al.
4,770,666 A 9/1988 Clauss
4,801,395 A 1/1989 Chazard et al.
4,813,482 A 3/1989 Walton
4,836,949 A 6/1989 Klajnscek
4,859,358 A * 8/1989 Gabriel et al. ..... 510/222
4,877,896 A 10/1989 Maldonado et al.
4,886,609 A 12/1989 Walton
4,891,160 A 1/1990 Vander Meer
4,894,220 A 1/1990 Nabi et al.
4,902,499 A 2/1990 Bolish, Jr. et al.
4,933,101 A 6/1990 Cilley et al.
4,968,451 A 11/1990 Scheibel et al.
4,976,879 A 12/1990 Maldonado et al.
5,015,466 A 5/1991 Parran, Jr. et al.
5,019,373 A 5/1991 Carter et al.
5,038,864 A 8/1991 Dunleavy
5,064,553 A 11/1991 Dixit et al.
5,098,590 A 3/1992 Dixit et al.
5,104,643 A 4/1992 Grollier et al.
5,114,606 A 5/1992 van Vliet et al.
5,130,043 A 7/1992 Prince et al.
5,160,450 A 11/1992 Okahara et al.
5,236,615 A 8/1993 Trinh et al.
5,280,117 A 1/1994 Kerschner et al.
5,332,528 A 7/1994 Pan et al.
5,370,865 A 12/1994 Yamagishi et al.
5,405,542 A 4/1995 Trinh et al.
5,413,727 A 5/1995 Drapier et al.
5,415,807 A 5/1995 Gosselink et al.
5,415,860 A 5/1995 Beucherie et al.
5,510,042 A 4/1996 Hartman et al.
5,510,306 A 4/1996 Murray
5,534,197 A 7/1996 Scheibel et al.
5,550,274 A 8/1996 Reierson
5,554,781 A 9/1996 Reierson
5,559,261 A 9/1996 Sivik
5,565,145 A 10/1996 Watson et al.
5,573,709 A 11/1996 Wells
5,607,680 A 3/1997 Brissonnet et al.
5,648,584 A 7/1997 Murray
5,648,585 A 7/1997 Murray et al.
5,686,024 A 11/1997 Dahanayake et al.
5,710,121 A 1/1998 Tracy et al.
5,798,326 A 8/1998 Goldstein et al.
5,804,542 A 9/1998 Scheper et al.
5,824,289 A 10/1998 Stoltz
5,849,960 A 12/1998 Singleton et al.
5,853,710 A 12/1998 Dehan et al.
5,858,343 A 1/1999 Szymczak
5,879,469 A * 3/1999 Avram ..... 134/25.2
5,902,574 A 5/1999 Stoner et al.
5,902,778 A 5/1999 Hartmann et al.
5,939,052 A 8/1999 White, Jr. et al.
5,968,893 A 10/1999 Manohar et al.
6,017,936 A 1/2000 Polson et al.
6,136,221 A 10/2000 Reierson
6,149,693 A 11/2000 Geib
6,150,222 A 11/2000 Gardner et al.
6,187,391 B1 2/2001 Kataoka et al.
6,220,352 B1 4/2001 Walton
6,222,077 B1 4/2001 Singleton
6,242,404 B1 6/2001 Dahanayake et al.
6,271,409 B1 8/2001 Geib
6,297,201 B1 10/2001 Geib
6,342,468 B1 1/2002 Geib
6,387,137 B1 5/2002 Geib
6,525,005 B1 * 2/2003 Kravitz et al. ..... 508/438
6,566,313 B1 5/2003 Hohenstein et al.
6,569,261 B1 5/2003 Aubay et al.
6,579,466 B1 6/2003 David et al.
6,593,288 B2 7/2003 Aubay et al.
6,767,410 B2 7/2004 Aubey et al.
6,767,560 B2 7/2004 Paek
6,864,314 B1 3/2005 Yeung et al.
6,924,260 B2 8/2005 Aubay
7,262,153 B2 8/2007 Shpakoff et al.
7,381,695 B2 * 6/2008 Minevski ..... 510/189
2003/0044469 A1 3/2003 Viladot Petit et al.
2003/0228339 A1 12/2003 El-Nokaly et al.
2004/0185027 A1 9/2004 Reierson et al.
2004/0247534 A1 12/2004 Stoltz
2005/0020466 A1 * 1/2005 Man et al. ..... 510/392
2005/0184273 A1 8/2005 Morelli et al.
2006/0088482 A1 4/2006 Wulknitz et al.
2006/0093559 A1 5/2006 Fabry
2006/0135384 A1 6/2006 Luu et al.
2006/0159631 A1 7/2006 Buch et al.
2006/0217286 A1 9/2006 Geoffroy et al.
2007/0145617 A1 6/2007 Finney et al.
2007/0166243 A1 7/2007 Yoshida et al.
2008/0028986 A1 2/2008 Futterer et al.
2008/0095719 A1 4/2008 Herrmann et al.
2008/0220031 A1 9/2008 Wunsch et al.

FOREIGN PATENT DOCUMENTS

EP 0011984 6/1980
EP 0066915 12/1982
EP 0132043 1/1985
EP 0132046 1/1985
EP 0219048 4/1987
EP 0488868 6/1992

| | | | |
|---|---|---|---|
| EP | 0561656 | | 9/1993 |
| EP | 0909809 | | 4/1999 |
| EP | 1196523 | | 4/2002 |
| EP | 1196527 | | 4/2002 |
| EP | 1196528 | | 4/2002 |
| FR | 2236926 | | 2/1975 |
| FR | 2334698 | | 7/1977 |
| GB | 849433 | | 9/1960 |
| GB | 1314897 | | 4/1973 |
| GB | 1475798 | | 6/1977 |
| GB | 1498520 | | 1/1978 |
| GB | 1537288 | | 12/1978 |
| GB | 1578930 | | 11/1980 |
| GB | 2 192 194 | A | 1/1988 |
| GB | 2 283 036 | A | 4/1995 |
| GB | 2 283 755 | A | 5/1995 |
| JP | 3157323 | A1 | 7/1991 |
| JP | 047547 | | 1/1992 |
| JP | 6313271 | | 11/1994 |
| JP | 2003342140 | A | 12/2003 |
| JP | 2005-013929 | | 1/2005 |
| WO | 9532272 | | 11/1995 |
| WO | 9532997 | | 12/1995 |
| WO | 9623859 | | 8/1996 |
| WO | 9623860 | | 8/1996 |
| WO | 9623861 | | 8/1996 |
| WO | 97/42287 | A1 | 11/1997 |
| WO | 9742288 | | 11/1997 |
| WO | 9838973 | | 9/1998 |
| WO | 9841505 | | 9/1998 |
| WO | 2004/082500 | A2 | 9/2004 |

OTHER PUBLICATIONS

U.S. Appl. No. 12/137,647 "Mono-, Di- and Polyol Alkoxylate Phosphate Esters in Oral Care Formulations and Methods for Using Same", Futterer et al., filed Jun. 12, 2008.

U.S. Appl. No. 12/137,738 "Hard Surface Cleaning Composition with Hydrophilizing Agent and Method for Cleaning Hard Surfaces", Futterer et al., filed Jun. 12, 2008.

U.S. Appl. No. 12/137,823 "Method for Recovering Crude Oil from a Subterranean Formation" Futterer et al., filed Jun. 12, 2008.

Office Action mailed Oct. 10, 2008 in U.S. Appl. No. 12/137,823.

Office Action mailed Oct. 3, 2008 in U.S. Appl. No. 12/137,647.

Notice of Allowance mailed Oct. 29, 2008 in U.S. Appl. No. 12/137,589.

Notice of Allowance mailed Nov. 13, 2008 in U.S. Appl. No. 12/137,738.

* cited by examiner

DETERGENT COMPOSITION WITH HYDROPHILIZING SOIL-RELEASE AGENT AND METHODS FOR USING SAME

CROSS REFERENCE TO RELATED APPLICATIONS

This claims the benefit of U.S. Provisional Patent Application No. 60/943,479 filed Jun. 12, 2007 and is incorporated by reference in its entirety.

FIELD OF THE INVENTION

This invention relates to a detergent composition containing a hydrophilizing soil-release agent and a method for cleaning laundry. More particularly, the present invention relates to a detergent composition containing mono-, di-, or polyol phosphate esters (like PEG phosphate esters, PPG phosphate esters, glycerine phosphate esters) as soil-release and anti-soil deposition agents. The present invention also relates to a method for providing soil release benefits to cotton fabric by contacting cotton articles with a water soluble and/or dispersible, organophosphorus material as a soil release agent. The present invention further relates to providing soil release benefits to all fabric in the laundry wash load.

BACKGROUND OF THE INVENTION

A wide variety of soil release agents for use in domestic and industrial fabric treatment processes such as laundering, fabric drying in hot air clothes dryers, and the like are known in the art. Various soil release agents have been commercialized and are currently used in detergent compositions and fabric softener/antistatic articles and compositions. Such soil release polymers typically comprise an oligomeric or polymeric ester "backbone".

The term "soil-release" in accordance with the present invention refers to the ability of the fabric to be washed or otherwise treated to remove soil and/or oily materials that have come into contact with the fabric. The present invention does not wholly prevent the attachment of soils to the fabric, but hinders such attachment and improves the cleanability of the fabric.

Soil release polymers are generally very effective on polyester or other synthetic fabrics where the grease, oil or similar hydrophobic stains spread out and form an attached film and thereby are not easily removed in an aqueous laundering process. Many soil release polymers have a less dramatic effect on "blended" fabrics, namely fabrics that comprise a mixture of cotton and synthetic material, and have little or no effect on cotton articles. The reason for the affinity of many soil release agents for synthetic fabric is that the backbone of a polyester soil release polymer typically comprises a mixture of terephthalate residues and ethyleneoxy or propyleneoxy polymeric units; the same materials that comprise the polyester fibers of synthetic fabric. This similar structure of soil release agents and synthetic fabric produce an intrinsic affinity between these compounds.

Extensive research in this area has yielded significant improvements in the effectiveness of polyester soil release agents yielding materials with enhanced product performance and formulatability. Modifications of the polymer backbone as well as the selection of proper end-capping groups has produced a wide variety of polyester soil release polymers. For example, end-cap modifications, such as the use of sulfoaryl moieties and especially the low cost isethionate-derived end-capping units, have increased the range of solubility and adjunct ingredient compatibility of these polymers without sacrifice to soil release effectiveness. Many polyester soil release polymers can now be formulated into both liquid as well as solid (i.e., granular) detergents.

As in the case of polyester soil release agents, producing an oligomeric or polymeric material that mimics the structure of cotton has not resulted in a cotton soil release polymer. Although cotton and polyester fabric are both comprised of long chain polymeric materials, they are chemically very different. Cotton is comprised of cellulose fibers that consist of anhydroglucose units joined by 1-4 linkages. These glycosidic linkages characterize the cotton cellulose as a polysaccharide whereas polyester soil release polymers are generally a combination of terephthalate and ethylene/propylene oxide residues. These differences in composition account for the difference in the fabric properties of cotton versus polyester fabric. Cotton is hydrophilic relative to polyester. Polyester is hydrophobic and attracts oily or greasy dirt and can easily be "dry cleaned". Importantly, the terephthalate and ethyleneoxy/propyleneoxy backbone of polyester fabric does not contain reactive sites, such as the hydroxyl moieties of cotton, which react with stains in different manner than synthetics. Many cotton stains become "fixed" and can only be resolved by bleaching the fabric.

Until now the development of an effective cotton soil release agent for use in a laundry detergent has been elusive. Attempts by others to apply the paradigm of matching the structure of a soil release polymer with the structure of the fabric, a method successful in the polyester soil release polymer field, has nevertheless yielded marginal results when applied to cotton fabric soil release agents. The use of methylcellulose, a cotton polysaccharide with modified oligomeric units, proved to be more effective on polyesters than on cotton.

For example, U.K. 1,314,897, published Apr. 26, 1973 teaches a hydroxypropyl methyl cellulose material for the prevention of wet-soil redeposition and improving stain release on laundered fabric. While this material appears to be somewhat effective on polyester and blended fabrics, the disclosure indicates these materials to be unsatisfactory at producing the desired results on cotton fabric.

Other attempts to produce a soil release agent for cotton fabric have usually taken the form of permanently modifying the chemical structure of the cotton fibers themselves by reacting a substrate with the polysaccharide polymer backbone. For example, U.S. Pat. No. 3,897,026 issued to Kearney, discloses cellulosic textile materials having improved soil release and stain resistance properties obtained by reaction of an ethylene-maleic anhydride co-polymer with the hydroxyl moieties of the cotton polymers. One perceived drawback of this method is the desirable hydrophilic properties of the cotton fabric are substantially modified by this process.

Non-permanent soil release treatments or finishes have also been previously attempted. U.S. Pat. No. 3,912,681 issued to Dickson teaches a composition for applying a non-permanent soil release finish comprising a polycarboxylate polymer to a cotton fabric. However, this material must be applied at a pH less than 3, a process neither suitable for consumer use nor compatible with laundry detergents which typically have a pH greater than 8.5.

U.S. Pat. No. 3,948,838 issued to Hinton, et al describes high molecular weight (500,000 to 1,500,000) polyacrylic polymers for soil release. These materials are used preferably with other fabric treatments, for example, durable press textile reactants such as formaldehyde. This process is also not readily applicable for use by consumers in a typical washing machine.

U.S. Pat. No. 4,559,056 issued to Leigh, et al. discloses a process for treating cotton or synthetic fabrics with a composition comprising an organopolysiloxane elastomer, an organosiloxaneoxyalkylene copolymer crosslinking agent and a siloxane curing catalyst. Organosilicone oligomers are well known by those skilled in the art as suds suppressors.

U.S. Pat. No. 5,332,528 to Pan, et al. discloses detergent compositions containing one or more anionic primary surfactants and a soil release composition consisting of a soil release agent and an anionic surfactant interactive nonionic hydrophile and/or an anionic surfactant interactive hydrophobic moiety or both, together with a soil release agent enhancer consisting of a polyhydroxy fatty acid amide.

Other soil release agents not comprising terephthalate and mixtures of polyoxy ethylene/propylene are vinyl caprolactam resins as disclosed by Rupert, et alia in U.S. Pat. Nos. 4,579,681 and 4,614,519. These disclosed vinyl caprolactam materials have their effectiveness limited to polyester fabrics, blends of cotton and polyester, and cotton fabrics rendered hydrophobic by finishing agents.

U.S. Pat. No. 6,242,404 to Dahanayake, et al. discloses a soil release polymer composition comprising a soil release polymer and a long chain nonionic alkoxylate surfactant and/or amphoteric that is able to generate very low critical micelle concentration values in water. Preferably, the soil release composition is incorporated in a detergent system such as a commercial laundry detergent which comprises a second anionic, nonionic or cationic surfactant and mixtures thereof. By lowering the cmc values of the detergent wash water to very low levels, the surfactant greatly enhances the performance of the soil release polymer.

In addition to the above cited art, the following disclose various soil release polymers or modified polyamines; U.S. Pat. No. 4,548,744, Connor, issued Oct. 22, 1985; U.S. Pat. No. 4,597,898, Vander Meer, issued Jul. 1, 1986; U.S. Pat. No. 4,877,896, Maldonado, et al., issued Oct. 31, 1989; U.S. Pat. No. 4,891,160, Vander Meer, issued Jan. 2, 1990; U.S. Pat. No. 4,976,879, Maldonado, et al., issued Dec. 11, 1990; U.S. Pat. No. 5,415,807, Gosselink, issued May 16, 1995; U.S. Pat. No. 4,235,735, Marco, et al., issued Nov. 25, 1980; WO 95/32272, published Nov. 30, 1995; U.K. Patent 1,537,288, published Dec. 29, 1978; U.K. Patent 1,498,520, published Jan. 18, 1978; German Patent DE 28 29 022, issued Jan. 10, 1980; Japanese Kokai JP 06313271, published Apr. 27, 1994; WO/1997/042288, published Nov. 13, 1997.

Many different approaches can be used to change the surface energy (hydrophilicity/hydrophobicity) and thus the adhesion properties of a given material. For example chemical treatments like plasma or ozone for polyethylene and polypropylene surfaces to increase hydrophilicity. Or physico-chemical treatments like the adhesion of surfactant molecules onto hydrophobic surfaces can alter them hydrophilic. Also the adhesion of polymers onto surfaces is used to change surface properties. One specific example would be the adsorption of polyethylene oxide (PEG). In all cases specific chemical groups are attached to the initial surface. These chemical groups change the surface energy and thus the adhesion properties and/or other surface properties like tendency of fouling or slip.

Two of the main disadvantages of the above mentioned treatments are poor durability and/or they are expensive/technically sophisticated. One example of the former is surfactants. They get easily washed away from the surface upon rinsing with e.g. water. An example for the latter is plasma or ozone treatment. Further, for some applications no satisfying solution is found up to date. One example would be improved anti-soil properties for cotton.

Materials that have a low surface energy, such as, for example, polyolefin polymers, have hydrophobic surfaces. The hydrophobic properties of such materials are not desirable in some applications and methods for hydrophilizing low surface energy substrates, including treatment with surfactants and/or high energy treatment, are known. Each of these methods has significant limitations. Surfactant treatments tend to wash off when a treated substrate is exposed to water and the charges imparted to the surface of a treated substrate by high energy treatment tend, particularly in the case of a thermoplastic polymer substrate, to dissipate. The hydrophilic properties of such surfactant treated substrates and high energy treated substrates thus tend to exhibit limited durability. Furthermore, the surfactants that are rinsed off of a treated substrate by exposure to water alter the properties of the water, such as lowering the surface tension, which may also be undesirable.

It would be advantageous to provide a laundry detergent composition which imparts improved anti-deposition and/or anti-adhesion properties to fabric being cleaned, particularly anti-soil deposition and anti-soil adhesion properties.

BRIEF DESCRIPTION OF THE DRAWINGS

FIG. 1, parts a, b, c and d, shows photographs of cloth samples of Example 1, namely the samples were un-treated/treated cotton swatches after soiling and washing/rinsing, wherein

Figure 1:
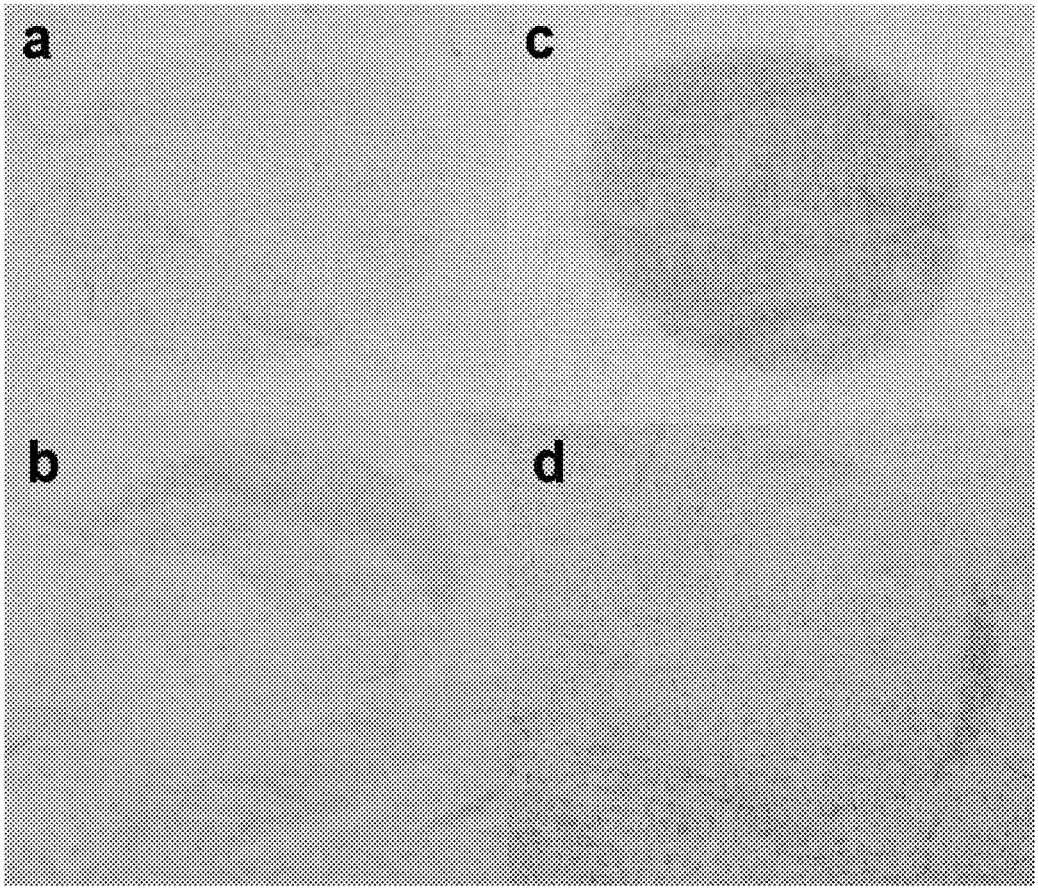

- part (a) was untreated, stained with Dirty Motor Oil control,
- part (b) was treated with PEG400/PPG425 phosphate ester, stained with Dirty Motor oil, and
- part (c) was untreated, stained with Cooked Vegetable Oil control,
- part (d) was treated with PEG400/PPG425 phosphate ester, stained with Cooked Vegetable Oil control; all soiled samples had been washed with SUN detergent.

SUMMARY OF THE INVENTION

Laundry detergent compositions useful in accordance with the present invention include special formulations such as pre-wash compositions, pre-soak compositions and compositions for hand or machine washing. Detergent compositions may be in the form of a concentrate which requires dilution or in the form of a dilute solution or form which can be applied directly to the cellulose containing fabric. Of course, the formulations of specific compositions for the various textile applications of the present soil release agent, e.g., laundry detergent or pre-soak, may differ due to the different applications to which the respective compositions are directed, as indicated herein. However, the improvements effected by the addition of the present soil release agent will be generally consistent through each of the various textile applications.

The composition and method of the present invention provides for soil release benefits on all cotton or cotton-synthetic fiber blend or "cellulose containing" articles whether laundered in the presence of a bleaching agent or not. The composition and method of the present invention provides for soil release benefits to cotton, cellulose, synthetic and cotton-synthetic blended fabric in the laundry wash load. The process or method of the present invention is equally effective when the laundry detergent compositions disclosed herein are solid or liquid. The solid laundry detergents may be in the form of granules, flakes or laundry bars. The liquid detergents can have a wide range of viscosity and may include heavy concentrates, pourable "ready" detergents, or light duty fabric pre-treatments.

The present invention provides detergent compositions with enhanced soil release properties and methods for using such compositions. More specifically, an object of the present invention is to provide textile detergent compositions comprising an organophosphorus soil release agent and at least one surfactant and methods of using such textile detergent compositions. The organophosphorus soil release agent is typically at least one mono-, di-, and polyol phosphate ester (for example PEG phosphate esters, PPG phosphate esters, glycerine phosphate esters).

The present invention also relates to laundry detergent compositions containing organophosphorus soil release agents for use with cotton and/or non-cotton fabrics, and optionally in combination with an additional suitable non-cotton secondary soil release agents, thereby providing laundry detergent compositions that provide soil release benefits to all fabric and to methods for providing cotton soil release to fabrics by contacting the compounds of the present invention with cotton fabric.

The present invention relates to laundry detergent compositions comprising:

a) at least about 0.01% to about 95% by weight, of a detersive surfactant selected from the group consisting of anionic, nonionic, zwitterionic, and amphoteric surfactants, and mixtures thereof;

b) from about 0.01 to about 10% by weight, of a soil release polymer having effective soil release on non-cotton fabric;

c) from about 0.01 to about 10% by weight, a water-soluble or dispersible, organophosphorous soil release agent comprising a hydrophilizing agent comprising:

(c)(I) an organophosphorus material selected from:

(c)(I)(1) organophosphorus compounds according to structure (I):

(I)

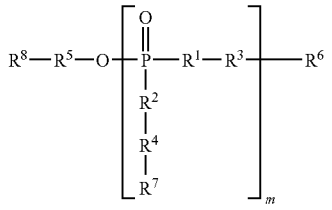

wherein:

each $R^1$ is and each $R^2$ is independently absent or O, provided that at least one of $R^1$ and $R^2$ is O, each $R^3$ is independently alkyleneoxy, poly(alkyleneoxy), which may optionally, be substituted on one or more carbon atom of such alkyleneoxy, or poly (alkyleneoxy) group by hydroxyl, alkyl, hydroxyalkyl, alkoxy, alkenyl, aryl, or aryloxy, $R^5$ is and each $R^4$ is independently absent or alkyleneoxy, poly(alkyleneoxy), which may optionally, be substituted on one or more carbon atom of such alkyleneoxy, or poly(alkyleneoxy) group by hydroxyl, alkyl, hydroxyalkyl, alkoxy, alkenyl, aryl, or aryloxy, $R^6$ and $R^8$ are each and each $R^7$ is independently H, or $(C_1\text{-}C_{30})$hydrocarbon, which hydrocarbon may optionally be substituted on one or more carbon atoms by hydroxyl, fluorine, alkyl, alkenyl or aryl and/or interrupted at one or more sites by an O, N, or S heteroatom, or —$POR^9R^{10}$, $R^9$ and $R^{10}$ are each independently hydroxyl, alkoxy, aryloxy, or $(C_1\text{-}C_{30})$hydrocarbon, which hydrocarbon may optionally be substituted on one or more carbon atoms by hydroxyl, fluorine, alkyl, alkenyl or aryl and/or interrupted at one or more sites by an O, N, or S heteroatom, and m is an integer of from 1 to 5, (c)(I)(2) salts of organophosphorus compounds according to structure (1), (c)(I)(3) condensation reaction products of two or more molecules of one or more organophosphorus compounds according to structure (I), and (c)(I)(4) mixtures comprising two or more of the compounds, salts, and/or reaction products of (b)(I)(1), (b)(I)(2), and (b)(I)(3).

If desired the composition may further comprise:

(c)(II) a vinyl alcohol material selected from:

(c)(II)(1) polymers comprising monomeric units according to structure (I-a):

(I-a)

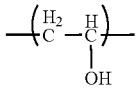

(c)(II)(2) salts of polymers (b)(II)(1), (c)(II)(3) reaction products of two or more molecules of one or more polymers (b)(II)(1), and (c)(II)(4) mixtures comprising two or more of the polymers, salts, and/or reaction products of (c)(II)(1), (c)(II)(2), and (c)(II)(3); and (d) optionally from about 0.05 to about 30% by weight, of a bleach.

(e) optionally from 0.01 to about 90% of carrier and adjunct ingredients.

In the present description, the organophosphorus material is termed a water-soluble or dispersible, organophosphorus release agent it is a soil release agent for cotton and non-cotton fabrics. However, this terminology is employed to distinguish the organophosphorus material from optional additional secondary soil-release agents or optional additional soil anti-deposition agents.

The present invention further relates to a method of providing soil release benefits to cotton fabric by contacting said fabric with a laundry composition comprising: a) at least about 0.001% by weight, a water-soluble or dispersible (preferably bleach stable), organophosphorous soil release agent comprising organophosphorus material "(c)(I)" according to the present invention; and b) the balance carrier and adjunct ingredients.

It is a further purpose of the present invention to provide a method for providing soil release benefits to white cotton fabric in the presence of a bleaching agent by contacting an aqueous solution of a bleach stable soil release agent with white cotton fabric in the presence of a bleaching agent.

It is a yet further purpose of the present invention to provide a method for providing soil release benefits to all fabrics that comprise the laundry wash load in the presence of a bleaching agent.

All percentages, ratios and proportions herein are by weight, unless otherwise specified. All temperatures are in degrees Celsius (° C.) unless otherwise specified. All documents cited are in relevant part, incorporated herein by reference.

The treatment of fibers with the phosphate esters changes surface properties.

The invention has a number of advantages. The phosphate esters are relatively inexpensive and easy to manufacture in comparison to many polymers used for surface treatments. The treatment is easy and fast from aqueous solution. The phosphate esters are considered non-toxic, non-irritant to skin and biodegradable.

The organophosphorus material can also be employed in a composition for stain removal which is applied to the soiled cloth just prior to washing. For example, it may be applied to pre-soak the stain before laundering.

DETAILED DESCRIPTION OF THE INVENTION

The compositions of the present invention comprise:

a) at least about 0.01% to about 95% by weight, of a detersive surfactant selected from the group consisting of anionic, nonionic, zwitterionic, and amphoteric surfactants, and mixtures thereof;

b) from about 0 to about 10% by weight or about 0.01 to about 10% by weight, of a soil release polymer having effective soil release on non-cotton fabric;

c) from about 0.01 to about 10% by weight, a water-soluble or dispersible, organophosphorus soil release agent according to the present invention; and d) the balance carrier and adjunct ingredients.

Preferably the laundry detergent compositions comprise:

a) at least about 0.01% to about 95% by weight, of a detersive surfactant selected from the group consisting of anionic, nonionic, zwitterionic, and amphoteric surfactants, and mixtures thereof;

b) from about 0 to about 10% or 0.01 to about 10% by weight, of an anionic soil release polymer having effective soil release on non-cotton fabric;

c) optionally from about 0.05 to about 30% by weight, of a bleach;

d) from about 0.01 to about 10% by weight, a water-soluble or dispersible, bleach stable, organophosphorus soil release agent according to the present invention; and e) the balance carrier and adjunct ingredients.

More preferred laundry detergent compositions comprise:

a) at least about 0.01% to about 95% by weight, of an anionic detersive surfactant;

b) at least about 0.01% to about 95% by weight, of a nonionic detersive surfactant;

c) from about 0 to about 10% by weight or about 0.01 to about 10% by weight, of a soil release polymer having effective soil release on non-cotton fabric;

d) optionally from about 0.05 to about 30% by weight, of a bleach;

e) from about 0.01 to about 10% by weight, a water-soluble or dispersible, bleach stable, organophosphorus soil release agent according to the present invention; and f) the balance carrier and adjunct ingredients.

Also preferred laundry detergent compositions comprise:

a) at least about 0.01% to about 95% by weight, of an anionic detersive surfactant selected from the group consisting of alkyl sulfates, alkyl ethoxy sulfates, and mixtures thereof;

b) at least about 0.01% to about 95% by weight, of a nonionic detersive surfactant;

c) from about 0 to about 10% by weight or about 0.01 to about 10% by weight, of an anionic soil release polymer having effective soil release on non-cotton fabric;

d) optionally from about 0.05 to about 30% by weight, of a bleach;

e) from about 0.01 to about 10% by weight, a water-soluble or dispersible, bleach stable, organophosphorus soil release agent according to the present invention; and f) the balance carrier and adjunct ingredients.

A further preferred laundry detergent composition comprises:

a) at least about 0.01% to about 95% by weight, of a polyhydroxy fatty acid amide nonionic detersive surfactant;

b) from about 0 to about 10% by weight or about 0.01 to about 10% by weight, of an anionic soil release polymer having effective soil release on non-cotton fabric;

c) optionally from about 0.05 to about 30% by weight, of a bleach;

d) from about 0.01 to about 10% by weight, a water-soluble or dispersible, bleach stable, organophosphorus soil release agent according to the present invention;

e) the balance carrier and adjunct ingredients; and f) sufficient alkaline material to provide the composition with a pH of about 7.2 to about 10.5 when measured as a 10% solution in water.

The water-soluble or dispersible, organophosphorus soil release agent according to the present invention comprises a hydrophilizing agent comprising:

(c)(I) an organophosphorus material selected from:

(c)(I)(1) organophosphorus compounds according to structure (I):

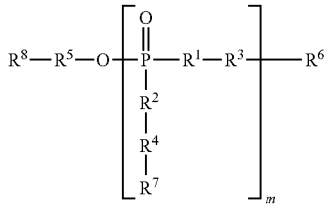

(I)

wherein:

each $R^1$ is and each $R^2$ is independently absent or O, provided that at least one of $R^1$ and $R^2$ is O, each $R^3$ is independently alkyleneoxy, poly(alkyleneoxy), which may optionally, be substituted on one or more carbon atom of such alkyleneoxy, or poly (alkyleneoxy) group by hydroxyl, alkyl, hydroxyalkyl, alkoxy, alkenyl, aryl, or aryloxy, $R^5$ is and each $R^4$ is independently absent or alkyleneoxy, poly(alkyleneoxy), which may optionally, be substituted on one or more carbon atom of such alkyleneoxy, or poly(alkyleneoxy) group by hydroxyl, alkyl, hydroxyalkyl, alkoxy, alkenyl, aryl, or aryloxy, $R^6$ and $R^8$ are each and each $R^7$ is independently H, or $(C_1\text{-}C_{30})$hydrocarbon, which hydrocarbon may optionally be substituted on one or more carbon atoms by hydroxyl, fluorine, alkyl, alkenyl or aryl and/or interrupted at one or more sites by an O, N, or S heteroatom, or —$POR^9R^{10}$, $R^9$ and $R^{10}$ are each independently hydroxyl, alkoxy, aryloxy, or $(C_1\text{-}C_{30})$hydrocarbon, which hydrocarbon may optionally be substituted on one or more carbon atoms by hydroxyl, fluorine, alkyl, alkenyl or aryl and/or interrupted at one or more sites by an O, N, or S heteroatom, and m is an integer of from 1 to 5, (c)(I)(2) salts of organophosphorus compounds according to structure (I), (c)(I)(3) condensation reaction products of two or more molecules of one or more organophosphorus compounds according to structure (I), and (c)(I)(4) mixtures comprising two or more of the compounds, salts, and/or reaction products of (b)(I)(1), (b)(I)(2), and (b)(I)(3).

If desired the composition may further comprise:

(c)(II) a vinyl alcohol material selected from:

(c)(II)(1) polymers comprising monomeric units according to structure (I-a):

(I-a)

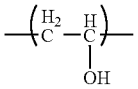

(c)(II)(2) salts of polymers (b)(II)(1), (c)(II)(3) reaction products of two or more molecules of one or more polymers (b)(II)(1), and (c)(II)(4) mixtures comprising two or more of the polymers, salts, and/or reaction products of (b)(II)(1), (b)(II)(2), and (b)(II)(3).

According to the present invention washing clothing with a laundry formulation comprising organophosphorus material such as mono-, di-, and polyol phosphate esters (like PEG phosphate esters, PPG phosphate esters, glycerine phosphate esters) makes it possible to confer, on the surface thus treated, persistent antideposition and/or antiadhesion properties with regard to soiling substances; in addition, the presence of mono-, di-, and polyol phosphate esters (like PEG phosphate esters, PPG phosphate esters, glycerine phosphate esters) makes it possible to improve the cleaning ability of the formulation.

Use of mono-, di-, and polyol phosphate esters (like PEG phosphate esters, PPG phosphate esters, glycerine phosphate esters) changes the surface properties of several surfaces by adsorption of the phosphate esters onto these surfaces. The treatment of the surfaces in most cases is simply by adsorption from aqueous solutions.

As used herein, the terminology "hydrophobic surface" means a surface that exhibits a tendency to repel water and to thus resist being wetted by water, as evidenced by a water contact angle of greater than or equal to 70°, more typically greater than or equal to 90°, and/or a surface free energy of less than or equal to about 40 dynes/cm.

As used herein, the terminology "hydrophilic surface" means a surface that exhibits an affinity for water and to thus be wettable by water, as evidenced by a water contact angle of less than 70°, more typically less than 60° and/or a surface energy of greater than about 40 dynes/cm, more typically greater than or equal to about 50 dynes/cm.

As used herein in reference to a hydrophobic surface, the term "hydrophilizing" means rendering such surface more hydrophilic and thus less hydrophobic, as indicated by a decreased water contact angle. One indication of increased hydrophilicity of a treated hydrophobic surface is a decreased water contact angle with a treated surface compared to the water contact angle with an untreated surface.

A used herein in reference to a substrate, the terminology "water contact angle" means the contact angle exhibited by a droplet of water on the surface as measured by a conventional image analysis method, that is, by disposing a droplet of water on the surface, typically a substantially flat surface, at 25° C., photographing the droplet, and measuring the contact angle shown in the photographic image.

Surface energy is estimated using the Young equation:

$$\cos(\theta)*\gamma_{lv}=\gamma_{sv}-\gamma_{sl}$$

with the contact angle θ, the interfacial energy $\gamma_{sv}$ between the solid and the vapor phase, the interfacial energy $\gamma_{sl}$ between the solid and the liquid phase, and the interfacial energy $\gamma_{lv}$ between the liquid and the vapor phase, and $\gamma_{sv}$ represents the surface energy of the solid.

As used herein, "molecular weight" in reference to a polymer or any portion thereof, means to the weight-average molecular weight ("$M_w$") of the polymer or portion, wherein $M_w$ of a polymer is a value measured by gel permeation chromatography and $M_w$ of a portion of a polymer is a value calculated according to known techniques from the amounts of monomers, polymers, initiators and/or transfer agents used to make the said portion.

As used herein, the notation "($C_n$-$C_m$)" in reference to an organic group or compound, wherein n and m are integers, means that the group or compound contains from n to m carbon atoms per such group or compound.

The term "persistent antideposition and/or antiadhesion properties" is understood to mean that the treated surface retains these properties over time, including after subsequent contacts with a soiling substance (for example rainwater, water from the distribution network, rinsing water to which rinsing products have or have not been added, spattered fats, soaps, and the like). This property of persistence can be observed beyond approximately 10 rinsing cycles, indeed even, in some specific cases where numerous rinsings are carried out (case of toilets, for example), beyond 100 rinsing cycles.

The expression of "conferring, on the surface thus treated, antideposition properties" means more particularly that the treated surface, brought into contact with a soiling substance in a predominantly aqueous medium, will not have a tendency to "capture" said soiling substance, which thus significantly reduces the deposition of the soiling substance on the surface.

The expression of "conferring, on the surface thus treated, antiadhesion properties" means more particularly that the treated surface is capable of interacting only very slightly with the soiling substance which has been deposited thereon, which makes possible easy removal of the soiling substances from the soiled treated surface; this is because, during the drying of the soiling substance brought into contact with the treated surface, the bonds developed between the soiling substance and the surface are very weak; thus, to break these bonds requires less energy (thus less effort) during the cleaning operation.

When it is said that the presence of mono-, di-, and polyol phosphate esters (like PEG phosphate esters, PPG phosphate esters, glycerine phosphate esters) makes it possible "to improve the cleaning ability" of a formulation, this means that, for the same amount of cleaning formulation (in particular a formulation for washing dishes by hand), the formulation comprising mono-, di-, or polyol phosphate esters makes it possible to clean a greater number of soiled objects than a formulation which is devoid thereof.

In addition, the deposition on a fabric of mono-, di-, and polyol phosphate esters (like PEG phosphate esters, PPG phosphate esters, glycerine phosphate esters) makes it possible to contribute antistatic properties to this surface; this property is particularly advantageous in the case of synthetic surfaces.

The presence of mono-, di-, and polyol phosphate esters (like PEG phosphate esters, PPG phosphate esters, glycerine phosphate esters) in detergent formulations makes it possible to render the surface of the washed fabric hydrophilic or to improve its hydrophilicity.

Textiles

The textile being laundered, or pre-treated with stain remover just prior to laundering, may be made from a variety of fibers comprising hydrophobic material having a hydrophobic surface and may be woven fabrics and non-woven fabrics.

Suitable textiles comprise, for example, "Cotton containing fabric", "Cellulose-containing fabric" and hydrophobic polymers.

"Cotton-containing fabric" means sewn or unsewn, woven or non-woven fabrics made of pure cotton or cotton blends including cotton woven fabrics, cotton knits, cotton denims, cotton yarns and the like. When cotton blends are employed, the amount of cotton in the fabric should be at least about 40 percent by weight cotton; preferably, more than about 60 percent by weight cotton; and most preferably, more than about 75 percent by weight cotton. When employed as blends, the companion material employed in the fabric can include one or more non-cotton fibers including synthetic fibers such as polyamide fibers (for example, nylon 6 and nylon 66), acrylic fibers (for example, polyacrylonitrile fibers), and polyester fibers (for example, polyethylene terephthalate), polyvinyl alcohol fibers (for example, Vinylon), polyvinyl chloride fibers, polyvinylidene chloride fibers, polyurethane fibers, polyurea fibers and aramide fibers.

"Cellulose containing fabric" means any cotton or noncotton containing cellulosic fabric or cotton or non-cotton containing cellulose blend including natural cellulosics and manmade cellulosics (such as Jute, flax, ramie, rayon, and the like). Included under the heading of manmade cellulose containing fabrics are regenerated fabrics that are well known in the art such as rayon. Other manmade cellulose containing fabrics include chemically modified cellulose fibers (e g., cellulose derivatized by acetate) and solvent-spun cellulose fibers (e.g. lyocell). Of course, included within the definition of cellulose containing fabric is any garment or yarn made of such materials. Similarly, "cellulose containing fabric" includes textile fibers made of such materials.

Hydrophobic polymers include for example, polyolefins, such as poylethylene, poly(isobutene), poly(isoprene), poly (4-methyl-1-pentene), polypropylene, ethylene-propylene copolymers, and ethylenepropylene-hexadiene copolymers; ethylene-vinyl acetate copolymers; styrene polymers, such as poly(styrene), poly(2-methylstyrene), styrene-acrylonitrile copolymers having less than about 20 mole-percent acrylonitrile, and styrene-2,2,3,3,-tetrafluoro-propyl methacrylate copolymers; halogenated hydrocarbon polymers, such as poly(chloro-trifluoroethylene), chlorotrifluoroethylene-tetrafluoroethylene copolymers, poly(hexafluoropropylene), poly(tetrafluoroethylene), tetrafluoroethylene-ethylene copolymers, poly(trifluoroethylene), poly(vinyl fluoride), and poly(vinylidene fluoride); vinyl polymers, such as poly (vinyl butyrate), poly(vinyl decanoate), poly(vinyl dodecanoate), poly(vinyl hexadecanoate), poly(vinyl hexanoate), poly(vinyl propionate), poly(vinyl octanoate), poly(heptafluoroisopropoxyethylene), 1-heptafluoroisopropoxy-methylethylene-maleic acid copolymers, poly(heptafluoroisopropoxypropylene), poly-(methacrylonitrile), poly(vinyl butyral), poly(ethoxyethylene), poly(methoxy-ethylene), and poly(vinyl formal); acrylic polymers, such as poly(n-butyl acetate), poly(ethyl acrylate), poly[(1-chlorodifluoromethyl) tetrafluoroethyl acrylate], poly[di(chloro-fluoromethyl)fluoromethyl acrylate], poly(1,1-dihydroheptafluorobutyl acrylate), poly(1,1-dihydropentafluoroisopropyl acrylate), poly (1,1-dihydropentadeca-fluorooctyl acrylate), poly (heptafluoroisopropyl acrylate), poly[5-(heptafluoroiospropoxy)-pentyl acrylate], poly[11-(heptafluoroiospropoxy)undecyl acrylate], poly[2-(heptafluoropropoxy)ethyl acrylate], and poly (nonafluoroisobutyl acrylate); methacrylic polymers, such as poly(benzyl methacrylate), poly(n-butyl methacrylate), poly (isobutyl meth-acrylate), poly(t-butyl methacrylate), poly(t-butylaminoethyl methacrylate), poly(dodecyl methacrylate), poly(ethyl methacrylate), poly(2-ethylhexyl methacrylate), poly(n-hexyl methacrylate), poly(dimethylaminoethyl methacrylate), poly(hydroxyethyl methacrylate), poly(phenyl methacrylate), poly(n-propyl methacrylate), poly(octadecyl methacrylate), poly(1,1-dihydropentadecafluorooctyl methacrylate), poly(heptafluoroisopropyl methacrylate), poly (heptadecafluorooctyl methacrylate), poly(1-hydrotetrafluoroethyl methacrylate), poly(1,1-dihydrotetrafluoropropyl methacrylate), poly(1-hydrohexafluoroisopropyl methacrylate), and poly(t-nonafluorobutyl methacrylate); polyethers, such as poly(chloral), poly(oxybutene)diol, poly(oxyisobutene)diol, poly(oxydecamethylene), poly(oxyethylene)-dimethyl ether polymers having molecular weights below about 1,500, poly(oxyhexamethylene)diol, poly(oxypropylene)diol, poly(oxypropylene)-dimethyl ether, and poly(oxytetramethylene); polyether copolymers, such as poly(oxyethylene)-poly(oxypropylene)-poly(oxyethylene) block copolymers, oxyethylene-oxypropylene copolymers having greater than about 20 mole percent oxypropylene, oxytetramethylene-oxypropylene copolymers, and block copolymers having oxyethylene-oxypropylene copolymer blocks separated by a poly(oxydimethylsilylene) block; polyamides, such as poly[imino(1-oxodecamethylene)], poly [imino(1-oxododecamethylene)] or nylon 12, poly[imino(1-oxohexamethylene)] or nylon 6, poly[imino(1-oxotetramethylene)] or nylon 4, poly (iminoazelaoyliminononamethylene), poly (iminosebacoyliminodecamethylene), and poly (iminosuberoyliminooctamethylene); polyimines, such as poly[(benzoylimino)ethylene], poly[(butyrylimino)ethylene], poly[(dodecanoylimino)ethylene], (dodecanoylimino) ethylene-(acetyleimino)trimethylene copolymers, poly [(heptanoylimino)ethylene], poly[(hexanoylimino) ethylene], poly{[(3-methyl)butyrylimino]ethylene}, poly [(pentadecafluorooctadecanoylimino)ethylene], and poly [(pentanoylimino)ethylene]; polyurethanes, such as those prepared from methylenediphenyl diisocyanate and butanediol poly(oxytetramethylene)diol, hexamethylene diisocyanate and triethylene glycol, and 4-methyl-1,3-phenylene diisocyanate and tripropylene glycol; polysiloxanes, such as poly (oxydimethylsilylene) and poly(oxymethylphenylsilylene); and cellulosics, such as amylose, amylopectin, cellulose acetate butyrate, ethyl cellulose, hemicellulose, and nitrocellulose.

In one embodiment, the substrate comprises one or more fibers. As used herein, the term "fiber" means a generally elongated article having a characteristic longitudinal dimension, typically a "length", and a characteristic transverse dimension, typically a "diameter" or a "width", wherein the ratio of the characteristic longitudinal dimension to the characteristic transverse dimension is greater than or equal to about 50, more typically greater than or equal to about 100.

Suitable fibers are those that have a hydrophobic surface and are typically hydrophobic synthetic polymer fibers, such as polyacrylonitrile fibers, poly(ethyleneterephthalate) fibers, and poly(olefin) fibers, such as, for example, poly (ethylene) fibers or poly(propylene) fibers.

In one embodiment, the hydrophilized fabric of the present invention is a woven fabric comprising fibers having hydrophobic surfaces.

In one embodiment, the hydrophilized fabric of the present invention is a non-woven fabric comprising fibers having hydrophobic surfaces.

In one embodiment, the fabric is a nonwoven fabric in a web format comprising fibers having hydrophobic surfaces. Nonwoven materials are well know, see, for example, Butler I., et. al., *Nonwovens Fabric Handbook*, Assoc. of the Nonwoven Fabrics Industry (1999).

Nonwoven fiber webs are typically formed by direct extrusion processes, such as spunbonding, meltblowing, solvent spinning, or electrospinning, in which the fibers and web are formed simultaneously, or by preformed fiber processes, such as dry laying or wet laying, in which fibers are laid into webs at a time subsequent to fiber formation, or by combinations of such processes, such as by spunbond-meltblown-spunbond, spunbond-airlaid, and meltblown-airlaid processes.

Typically, at least a portion of the fibers of a nonwoven fiber web are oriented with some non-zero angle relative to other fibers of the web. Places were two or more fibers touch, in either an adjacent or overlapping manner, are typically called "junctions". The fibers of a nonwoven fiber web are typically joined to one or more of the other fibers of the web, by, for example, thermal bonding, pressure bonding, ultrasonic bonding, or solvent bonding, at least some of the junctions.

In one embodiment, two or more nonwoven fiber webs are stacked to form a nonwoven fiber web laminate material. In another embodiment, one or more nonwoven fiber webs are stacked with one or more other materials, such as non-porous polymeric films or sheets, to form composite laminate materials.

Phosphate Esters (Organophosphorus Material)

As used herein, the term "alkyl" means a monovalent saturated straight chain or branched hydrocarbon radical, typically a monovalent saturated $(C_1\text{-}C_{30})$hydrocarbon radical, such as for example, methyl, ethyl, n-propyl, iso-propyl, n-butyl, sec-butyl, t-butyl, pentyl, or n-hexyl, which may optionally be substituted on one or more of the carbon atoms of the radical. In one embodiment, an alkyl radical is substituted on one or more carbon atoms of the radical with alkoxy, amino, halo, carboxy, or phosphono, such as, for example, hydroxymethyl hydroxyethyl, methoxymethyl, ethoxymethyl, isopropoxyethyl, aminomethyl, chloromethyl or trichloromethyl, carboxyethyl, or phosphonomethyl.

As used herein, the term "hydroxyalkyl" means an alkyl radical that is substituted on one of its carbon atoms with a hydroxyl group.

As used herein, the term "alkoxyl" means an oxy radical that is substituted with an alkyl group, such as for example, methoxyl, ethoxyl, propoxyl, isopropoxyl, or butoxyl, which may optionally be further substituted on one or more of the carbon atoms of the radical.

As used herein, the term "cylcoalkyl" means a saturated cyclic hydrocarbon radical, typically a $(C_3\text{-}C_8)$ saturated cyclic hydrocarbon radical, such as, for example, cyclohexyl or cyclooctyl, which may optionally be substituted on one or more of the carbon atoms of the radical.

As used herein, the term "alkenyl" means an unsaturated straight chain, branched chain, or cyclic hydrocarbon radical that contains one or more carbon-carbon double bonds, such as, for example, ethenyl, 1-propenyl, or 2-propenyl, which may optionally be substituted on one or more of the carbon atoms of the radical.

As used herein, the term "aryl" means a monovalent unsaturated hydrocarbon radical containing one or more six-membered carbon rings in which the unsaturation may be represented by three conjugated double bonds, such as for example, phenyl, naphthyl, anthryl, phenanthryl, or biphenyl, which may optionally be substituted one or more of carbons of the ring. In one embodiment, an aryl radical is substituted on one or more carbon atoms of the radical with hydroxyl, alkenyl, halo, haloalkyl, or amino, such as, for example, methylphenyl, dimethylphenyl, hydroxyphenyl, chlorophenyl, trichloromethylphenyl, or aminophenyl.

As used herein, the term "aryloxy" means an oxy radical that is substituted with an aryl group, such as for example, phenyloxy, methylphenyl oxy, isopropylmethylphenyloxy.

As used herein, the indication that a radical may be "optionally substituted" or "optionally further substituted" means, in general, that is unless further limited, either explicitly or by the context of such reference, that such radical may be substituted with one or more inorganic or organic substituent groups, such as, for example, alkyl, alkenyl, aryl, aralkyl, alkaryl, a hetero atom, or heterocyclyl, or with one or more functional groups that are capable of coordinating to metal ions, such as hydroxyl, carbonyl, carboxyl, amino, imino, amido, phosphonic acid, sulphonic acid, or arsenate, or inorganic and organic esters thereof, such as, for example, sulphate or phosphate, or salts thereof.

As used herein, the terminology "$(C_x\text{-}C_y)$" in reference to an organic group, wherein x and y are each integers, indicates that the group may contain from x carbon atoms to y carbon atoms per group.

As described above, the water-soluble or dispersible, organophosphorus soil release agent according to the present invention comprises a hydrophilizing agent comprising:

(c)(I) an organophosphorus material selected from:

(c)(I)(1) organophosphorus compounds according to structure (I):

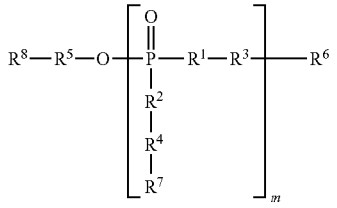

(I)

wherein:

each $R^1$ is and each $R^2$ is independently absent or O, provided that at least one of $R^1$ and $R^2$ is O, each $R^3$ is independently alkyleneoxy, poly(alkyleneoxy), which may optionally, be substituted on one or more carbon atom of such alkyleneoxy, or poly (alkyleneoxy) group by hydroxyl, alkyl, hydroxyalkyl, alkoxy, alkenyl, aryl, or aryloxy, $R^5$ is and each $R^4$ is independently absent or alkyleneoxy, poly(alkyleneoxy), which may optionally, be substituted on one or more carbon atom of such alkyleneoxy, or poly(alkyleneoxy) group by hydroxyl, alkyl, hydroxyalkyl, alkoxy, alkenyl, aryl, or aryloxy, $R^6$ and $R^8$ are each and each $R^7$ is independently H, or $(C_1\text{-}C_{30})$hydrocarbon, which hydrocarbon may optionally be substituted on one or more carbon atoms by hydroxyl, fluorine, alkyl, alkenyl or aryl and/or interrupted at one or more sites by an O, N, or S heteroatom, or —$POR^9R^{10}$, $R^9$ and $R^{10}$ are each independently hydroxyl, alkoxy, aryloxy, or ($C_1$-$C_{30}$)hydrocarbon, which hydrocarbon may optionally be substituted on one or more carbon atoms by hydroxyl, fluorine, alkyl, alkenyl or aryl and/or interrupted at one or more sites by an O, N, or S heteroatom, and m is an integer of from 1 to 5, (c)(I)(2) salts of organophosphorus compounds according to structure (I), (c)(I)(3) condensation reaction products of two or more molecules of one or more organophosphorus compounds according to structure (I), and (c)(I)(4) mixtures comprising two or more of the compounds, salts, and/or reaction products of (b)(I)(1), (b)(I)(2), and (b)(I)(3).

Organophosphorus material suitable for use in the present laundry and presoaking compositions are also described in U.S. provisional patent application No. 60/842,265, filed Sep. 5, 2006 and 60/812,819, filed Jun. 12, 2006, both incorporated herein by reference.

In one embodiment, $R^6$ and $R^8$ are each and each $R^7$ is independently H, ($C_1$-$C_{30}$)alkyl, ($C_1$-$C_{30}$)alkenyl, or ($C_7$-$C_{30}$)alkaryl.

In one embodiment, each $R^1$ and each $R^2$ is O, and the organophosphorus compound is selected from:

(II)(1) an organophosphate ester according to structure (II):

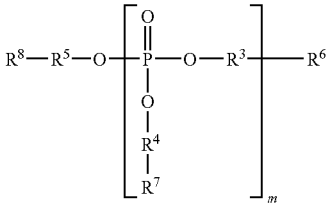

(II)

wherein $R^3$, $R^4$, $R^5$, $R^6$, $R^7$, $R^8$, and m are each as described above, (II)(2) salts of organophosphorus compounds according to structure (II), (II)(3) condensation reaction products of two or more molecules of one or more organophosphorus compounds according to structure (II), and (II)(4) mixtures comprising two or more of the compounds, salts, and/or reaction products of (II)(1), (II)(2), and (II)(3).

In one embodiment, each $R^1$ is absent, each $R^2$ is O, and the organophosphorus compound is selected from:

(III)(1) an organophosphonate ester according to structure (III):

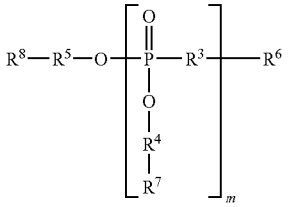

(III)

wherein $R^3$, $R^4$, $R^5$, $R^6$, $R^7$, $R^8$, and m are each as described above, (III)(2) salts of organophosphorus compounds according to structure (III), (III)(3) condensation reaction products of two or more molecules of one or more organophosphorus compounds according to structure (III), and (III)(4) mixtures comprising two or more of the compounds, salts, and/or reaction products of (III)(1), (III)(2), and (III)(3).

In one embodiment, each $R^1$ is O, each $R^2$ is absent, and the organophosphorus compound is selected from:

(IV)(1) an organophosphonate ester according to structure (IV):

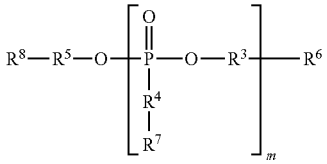

(IV)

wherein $R^3$, $R^4$, $R^5$, $R^6$, $R^7$, $R^8$, and m are each as described above, (IV)(2) salts of organophosphorus compounds according to structure (IV), (IV)(3) condensation reaction products of two or more molecules of one or more organophosphorus compounds according to structure (IV), and (IV)(4) mixtures comprising two or more of the compounds, salts, and/or reaction products of (IV)(1), (IV)(2), and (IV)(3).

In one embodiment, each $R^3$ is a divalent radical according to structure (V), (VI), (VII), or (VIII):

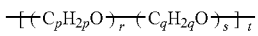

(V)

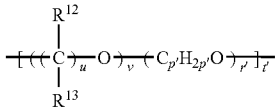

(VI)

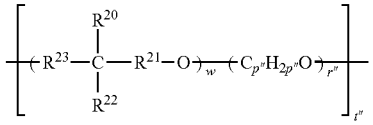

(VII)

-continued (VIII)

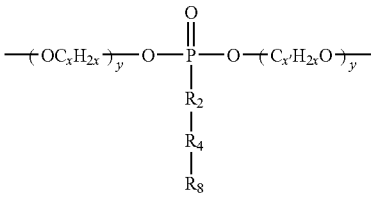

wherein:

each $R^{12}$ and each $R^{13}$ is independently H, hydroxyl, alkyl, hydroxyalkyl, alkoxy, alkenyl, aryl, aryloxy, or two $R^{12}$ groups that are attached to the adjacent carbon atoms may be fused to form, together with the carbon atoms to which they are attached, a ($C_6$-$C_8$)hydrocarbon ring, $R^{20}$ is H, hydroxyl, alkyl, hydroxyalkyl, alkoxy, alkenyl, aryl, or aryloxy $R^{22}$ is hydroxyl or hydroxyalkyl, provided that $R^{20}$ and $R^{22}$ are not each hydroxyl, $R^{23}$ and $R^{21}$ are each independently methylene or poly (methylene), p, p', p", q, and x are each independently integers of from 2 to 5, each r, s, r', r", and y is independently a number of from 0 to 25, provided that at least one of r and s is not 0, u is an integer of from 2 to 10, v and w are each numbers of from 1 to 25, and t, t', and t" are each numbers of from 1 to 25, provided that the product of the quantity (r+s) multiplied times t is less than or equal to about 100, the product of the quantity (v+r') multiplied times t' is less than or equal to about 100, and the product of the quantity (w+r") multiplied time t" is less than or equal to about 100.

In one embodiment, each $R^4$ and each $R^5$ is independently absent or a divalent radical according to structure (V), (VI), or (VII), wherein $R^{12}$, $R^{13}$, $R^{20}$, $R^{21}$, $R^{22}$, $R^{23}$, p, p', p", q, r, r', r", s, t, t", t, u, v, w, x, and y are as described above.

In one embodiment, each $R^3$ is independently a divalent radical according to structure (V), (VI), or (VII) wherein $R^{12}$, $R^{13}$, $R^{20}$, $R^{21}$, $R^{22}$, $R^{23}$, p, p', p", q, r, r', r", s, t, t", t, u, v, w, x, and y are as described above, and $R^4$ and $R^5$ are each independently absent or $R^3$.

In one embodiment, each $R^3$ is independently a divalent radical according to structure (V), wherein p is 2, 3, or 4, r is an integer from 1 to 25, s is 0, t is an integer of from 1 to 2, and $R^4$ and $R^5$ are each independently absent or $R^3$.

In one embodiment, each $R^3$ is independently a divalent radical according to structure (VI), wherein the $R^{12}$ groups are fused to form, including the carbon atoms to which they are attached, a ($C_6$-$C_8$) hydrocarbon ring, each $R^{13}$ is H, p' is 2 or 3, u is 2, v is an integer of from 1 to 3, r' is an integer from 1 to 25, t' is an integer of from 1 to 25, the product of the quantity (v+r') multiplied times t" is less than or equal to about 100, more typically less than or equal to about 50, and $R^4$ and $R^5$ are each independently absent or $R^3$.

In one embodiment, each $R^3$ is independently a divalent radical according to structure (VII), wherein $R^{20}$ is hydroxyl or hydroxyalkyl, $R^{22}$ is H, alkyl, hydroxyl, or hydroxyalkyl, provided that $R^{20}$ and $R^{22}$ are not each hydroxyl, $R^{21}$ and $R^{23}$ are each independently methylene, di(methylene), or tri(methylene), w is 1 or 2, p" is 2 or 3, r" is an integer of from 1 to 25, t" is an integer of from 1 to 25, the product of the quantity (w+r") multiplied times t" is less than or equal to about 100, more typically less than or equal to about 50, and $R^4$ and $R^5$ are each independently absent or $R^3$.

In one embodiment of the organophosphorus compound according to structure (II), $R^6$ and $R^8$ are each and each $R^7$ is independently H or ($C_1$-$C_{30}$)hydrocarbon, which hydrocarbon may optionally be substituted on one or more carbon atoms by hydroxyl, fluorine, alkyl, alkenyl or aryl and/or interrupted at one or more sites by an O, N, or S heteroatom, or —$POR^9R^{10}$, more typically, $R^6$, $R^8$, and each $R^7$ are each H, $R^4$ and $R^5$ are each absent, each $R^3$ is independently a divalent radical according to structure (V), (VI), or (VII), and m is an integer of from 1 to 5.

In one embodiment of the organophosphorus compound according to structure (II):

$R^6$, $R^8$, and each $R^7$ are each H, $R^4$ and $R^5$ are each absent, each $R^3$ is independently a divalent radical according to structure (V), each p is independently 2, 3,or 4, more typically 2 or 3, each r is independently a number of from 1 to about 100, more typically from 2 to about 50, each s is 0, each t is 1, and m is an integer of from 1 to 5.

In one embodiment, the organophosphorus material is selected from:

(X)(1) organophosphorus compounds according to structure (IX):

(IX)

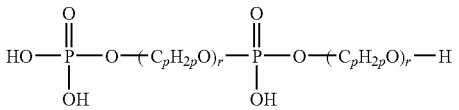

wherein:

p is 2, 3, or 4, more typically 2 or 3, r is a number of from 4 to about 50, (IX)(2) salts organophosphorus compounds according to structure (IX), and (IX)(3) mixtures comprising two or more of the compounds and/or salts of (IX)(1) and (IX)(2).

In one embodiment of the organophosphorus compound according to structure (II):

$R^6$, $R^8$, and each $R^7$ are each H, $R^4$ and $R^5$ are each absent, each $R^3$ is independently a divalent radical according to structure (VI), the $R^{12}$ groups are fused to form, including the carbon atoms to which they are attached, a ($C_6$-$C_8$)hydrocarbon ring, each $R^{13}$ is H p' is 2 or 3, u is 2, v is 1, r' is a number of from 1 to 25, t' is a number of from 1 to 25, the product of the quantity (v+r') multiplied times t' is less than or equal to about 100, and m is an integer of from 1 to 5.

In one embodiment of the organophosphorus compound according to structure (II):

$R^6$, $R^8$, and each $R^7$ are each H, $R^4$ and $R^5$ are each absent, each $R^3$ is independently a divalent radical according to structure (VII), $R^{20}$ is hydroxyl or hydroxyalkyl, $R^{22}$ is H, alkyl, hydroxyl, or hydroxyalkyl, $R^{23}$ and $R^{21}$ are each independently methylene, di(methylene), or tri(methylene), w is 1 or 2, p" is 2 or 3, r" is a number of from 1 to 25, t" is a number of from 1 to 25 the product of the quantity (w+r") multiplied times t" is less than or equal to about 100, and m is an integer of from 1 to 5.

In one embodiment, the organophosphorus compound is according to structure (III), each $R^3$ is a divalent radical according to structure (V) with s=0 and t=1, $R^4$ and $R^5$ are each absent, and $R^6$, $R^7$, and $R^8$ are each H.

In one embodiment, the organophosphorus compound is according to structure (IV), wherein R3 and R5 are each according to structure (V), with s=0 and t=1, and $R^6$ and $R^8$ are each H.

In one embodiment, the organophosphorus material (b)(I) comprises a condensation reaction product of two or more molecules according to structure (I).

In one embodiment, the organophosphorus material (b)(I) comprises a condensation reaction product of two or more molecules according to structure (I) in the form of a linear molecule, such as, for example, a linear condensation reaction product according to structure (X), formed by condensation of a molecule according to structure (II) with a molecule according to structure (IV):

(XI)

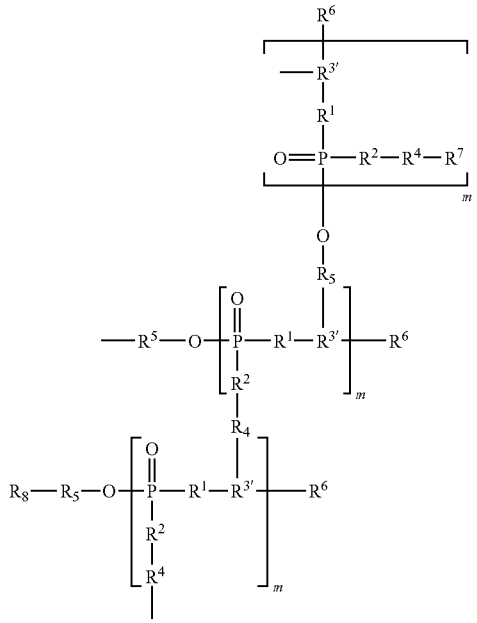

wherein $R^1$, $R^2$, $R^4$, $R^5$, $R^6$, $R^7$, $R^8$, and m are each as described above, and each $R^3$ is independently a residue of an $R^3$ group of a compound according to structure (I), as described above, wherein the $R^3$ group is a alkyleneoxy or poly(alkyleneoxy) moiety substituted with hydroxyl-, hydroxyalkyl-, hydroxyalkyleneoxy- or hydroxypoly(alkyleneoxy)- on one or more carbon atoms of the alkyleneoxy or poly(alkyleneoxy) moiety, and —$R^{3'}$—$R_4$— and —$R^{3'}$—$R^5$— each represent a respective linkage formed by condensation of such an $R^3$ group and a —$R^{3'}$—$R^5$— or $R^8$—$R^5$— group of molecules of another molecule of a compound according to structure (I).

In one embodiment, the organophosphorus material (b)(I) comprises a condensation reaction product of two or more molecules according to structure (I) and the condensation reaction product forms a covalently crosslinked organophosphorus network. Typically the solubility of the covalently crosslinked organophosphorus network in water is less than (X)

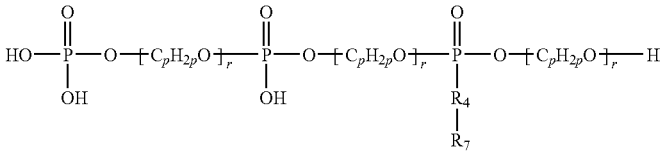

wherein $R^4$, $R^7$, p, r are each as described above.

In one embodiment, the organophosphorus material (b)(I) comprises a condensation reaction product of two or more molecules according to structure (I) in the form of a crosslinked network. A portion of an exemplary crosslinked condensation reaction product network is illustrated by structure (XI):

that of the organophosphorus compound according to structure (I), more typically, the covalently crosslinked organophosphorus network is substantially insoluble in water.

As used herein, the term "salts" refers to salts prepared from bases or acids including inorganic or organic bases and inorganic or organic acids.

In one embodiment, the organophosporus material (b)(I) is in the form of a salt that comprises an anion derived (for example, by deprotonation of a hydroxyl or a hydroxyalkyl substituent) from of an organophosphorus compound according to structure (I) and one or more positively charged counterions derived from a base.

Suitable positively charged counterions include inorganic cations and organic cations, such as for example, sodium cations, potassium cations, calcium cations, magnesium cations, copper cations, zinc cations, ammonium cations, tetraalkylammonium cations, as well as cations derived from primary, secondary, and tertiary amines, and substituted amines.

In one embodiment, the cation is a monovalent cation, such as for example, $Na^+$, or $K^+$.

In one embodiment, the cation is a polyvalent cation, such as, for example, $Ca^{+2}$, $Mg^{+2}$, $Zn^{+2}$, $Mn^{+2}$, $Cu^{+2}$, $Al^{+3}$, $Fe^{+2}$, $Fe^{+3}$, $Ti^{+4}$, $Zr^{+4}$, in which case the organophosporus compound may be in the form of a "salt complex" formed by the organophosphorus compound and the polyvalent cation. For organophosphorus compound having two or more anionic sites, e.g., deprotonated hydroxyl substituents, per molecule, the organophosphorus compound-polyvalent cation complex can develop an ionically crosslinked network structure. Typically the solubility of the ionically crosslinked organophosphorus network in water is less than that of the organophosphorus compound according to structure (I), more typically, the ionically crosslinked organophosphorus network is substantially insoluble in water.

Suitable organophosphorus compounds can be made by known synthetic methods, such as by reaction of one or more compounds, each having two or more hydroxyl groups per molecule, with phosphoric acid, polyphosphoric acid, and or phosphoric anhydride, such as disclosed, for example, in U.S. Pat. Nos. 5,550,274, 5,554,781, and 6,136,221.

In one embodiment, cations are immobilized on a water insoluble substrate to form a water insoluble cationic particle and the hydophilizing layer further comprises cationic particles. Suitable substrates include inorganic oxide particles, including for example, oxides of single elements, such as cerium oxide, titanium oxide, zirconium oxide, halfnium oxide, tantalum oxide, tungsten oxide, silicon dioxide, and bismuth oxide, zinc oxide, indium oxide, and tin oxide, and mixtures of such oxides, as well as oxides of mixtures of such elements, such as cerium-zirconium oxides. Such particle may exhibit a mean particle diameter ("$D_{50}$") of from about 1 nanometer ("nm") to about 50 micrometers ("μm"), more typically from about 5 to about 1000 nm, even more typically from about 10 to about 800 nm, and still more typically from about 20 to about 500 nm, as determined by dynamic light scattering or optical microscopy. In one embodiment, aluminum cations are immobilized on silica particles.

Vinyl Alcohol Material

If desired the laundry detergent composition, or composition for pre-treating stains by pre-soaking just prior to laundering, may further comprise:

(c)(II) a vinyl alcohol material selected from:

(c)(II)(1) polymers comprising monomeric units according to structure (I-a):

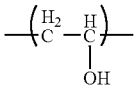

(I-a)

(c)(II)(2) salts of polymers (b)(II)(1), (c)(II)(3) reaction products of two or more molecules of one or more polymers (b)(II)(1), and (c)(II)(4) mixtures comprising two or more of the polymers, salts, and/or reaction products of (b)(II)(1), (b)(II)(2), and (b)(II)(3).

In one embodiment, the vinyl alcohol polymer exhibits a weight average molecular weight of greater than or equal to about 10,000, more typically from about 10,000 to about 100,000, even more typically from about 10,000 to about 30,000. In an alternative embodiment, which offers improved durability, the vinyl alcohol polymer a weight average molecular weight of greater than or equal to about 100,000, more typically form about 100,000 to about 200,000. In another embodiment, which offers a balance between processability and durability, the vinyl alcohol polymer exhibits a weight average molecular weight of greater than or equal to about 50,000, more typically from about 50,000 to about 150,000, even more typically from about 80,000 to about 120,000.

In the present application, average molecular weights are weight average molecular weights unless otherwise specified.

In one embodiment, the vinyl alcohol polymer is made by polymerizing a vinyl ester monomer, such as for example, vinyl acetate, to form a polymer, such as a poly(vinyl acetate) homopolymer or a copolymer comprising monomeric units derived from vinyl acetate, having a hydrocarbon backbone and ester substituent groups, and then hydrolyzing at least a portion of the ester substitutent groups of the polymer to form hydroxy-substituted monomeric units according to structure (I-a). In one embodiment, which offers improved solubility in water and improved processability, the vinyl alcohol polymer exhibits a degree of hydrolysis of greater than or equal to about 88%, more typically from about 88% to about 95%. As used herein in reference to a vinyl alcohol polymer that is made by hydrolyzing a polymer initially having a hydrocarbon backbone and ester substituent groups, the term "degree of hydrolysis" means the relative amount, expressed as a percentage, of vinyl ester-substituted monomeric units that were hydrolyzed to form hydroxy-substituted monomeric units. In another embodiment, which offers improved solubility in water and improved durability, the vinyl alcohol polymer exhibits a degree of hydrolysis of greater than or equal to about 99%. In yet another embodiment, which offers a compromise between solubility in water and durability, the polymer exhibits a degree of hydrolysis from about 92 to about 99%.

In one embodiment, the vinyl alcohol polymer has a linear polymeric structure. In an alternative embodiment, the vinyl alcohol polymer has a branched polymeric structure.

In one embodiment, the vinyl alcohol polymer is a vinyl alcohol homopolymer that consists solely of monomeric units according to structure (I-a).

In one embodiment, the vinyl alcohol polymer is a vinyl alcohol copolymer that comprises monomeric units having a structure according to structure (I-a) and further comprises comonomeric units having a structure other than structure (I-a). In one embodiment, the vinyl alcohol polymer is a copolymer that comprises hydroxy-substituted monomeric units according to (I-a) and ester substituted monomeric units and is made by incomplete hydrolysis of a vinyl ester homopolymer.

In one embodiment a vinyl alcohol copolymer comprises greater than or equal to about 50 mole % ("mol %"), more typically greater or equal to than about 80 mol %, monomeric units according to structure (I-a) and less than about 50 mol %, more typically less than about 20 mol %, comonomeric units having a structure other than structure (I-a).

As described above, vinyl alcohol polymers having monomeric units according to structure (I-a) are typically derived from polymerization of vinyl ester monomers and subsequent hydrolysis of vinyl ester-substituted monomeric units of the polymer. Suitable vinyl alcohol copolymers are typically derived by copolymerization of the vinyl ester monomer with any ethylenically unsaturated monomer that is copolymerizable with the vinyl ester monomer, including for example, other vinyl monomers, allyl monomers, acrylic acid, methacrylic acid, acrylic ester monomers, methacrylic ester monomers, acrylamide monomers, and subsequent hydrolysis of at least a portion of the ester-substituted monomeric units to form hydroxy-substituted monomeric units according to structure (I-a).

In one embodiment, the vinyl alcohol polymer comprises monomeric units according to structure (I-a) and further comprises hydrophilic monomeric units other than the monomeric according to structure (I-a). As used herein, the term "hydrophilic monomeric units" are those wherein homopolymers of such monomeric units are soluble in water at 25° C. at a concentration of 1 wt % homopolymer, and include, for example, monomeric units derived from, for example, hydroxy($C_1$-$C_4$)alkyl(meth)acrylates, (meth)acrylamide, ($C_1$-$C_4$)alkyl(meth)acrylamides, N,N-dialkyl-acrylamides, alkoxylated(meth)acrylates, poly(ethylene glycol)-mono methacrylates and poly(ethyleneglycol)-monomethylether methacrylates, hydroxy($C_1$-$C_4$)acrylamides and methacrylamides, hydroxyl($C_1$-$C_4$)alkyl vinyl ethers, N-vinylpyrrole, N-vinyl-2-pyrrolidone, 2- and 4-vinylpyridine, ethylenically unsaturated carboxylic acids having a total of 3 to 5 carbon atoms, amino($C_1$-$C_4$)alkyl, mono($C_1$-$C_4$)alkylamino($C_1$-$C_4$)alkyl, and di($C_1$-$C_4$)alkylamino($C_1$-$C_4$)alkyl(meth)acrylates, allyl alcohol, dimethylaminoethyl methacrylate, dimethylaminoethylmethacrylamide.

In one embodiment, the vinyl alcohol polymer comprises monomeric units according to structure (I-a) and further comprises hydrophobic monomeric units. As used herein, the term "hydrophobic monomeric units" are those wherein homopolymers of such monomeric units are insoluble in water at 25° C. at a concentration of 1 wt % homopolymer, and include, for example, monomeric units derived from ($C_1$-$C_{18}$)alkyl and ($C_5$-$C_{18}$)cycloalkyl (meth)acrylates, ($C_5$-$C_{18}$)alkyl(meth)acrylamides, (meth)acrylonitrile, vinyl($C_1$-$C_{18}$)alkanoates, ($C_2$-$C_{18}$)alkenes, ($C_2$-$C_{18}$)haloalkenes, styrene, ($C^1$-$C_6$)alkylstyrenes, ($C_4$-$C_{12}$)alkyl vinyl ethers, fluorinated ($C_2$-$C_{10}$)alkyl(meth)acrylates, ($C_3$-$C_{12}$)perfluoroalkylethylthiocarbonylaminoethyl(meth)acrylates, (meth)acryloxyalkylsiloxanes, N-vinylcarbazole, ($C_1$-$C_{12}$)alkyl maleic, fumaric, itaconic, and mesaconic acid esters, vinyl acetate, vinyl propionate, vinyl butyrate, vinyl valerate, chloroprene, vinyl chloride, vinylidene chloride, vinyltoluene, vinyl ethyl ether, perfluorohexyl ethylthiocarbonylaminoethyl methacrylate, isobornyl methacrylate, trifluoroethyl methacrylate, hexa-fluoroisopropyl methacrylate, hexafluorobutyl methacrylate, tristrimethylsilyloxysilylpropyl methacrylate, and 3-methacryloxypropylpentamethyldisiloxane.

As used herein, the term "(meth)acrylate" means acrylate, methacrylate, or acrylate and methacrylate and the term "(meth)acrylamide" means acrylamide, methacrylamide or acrylamide and methacrylamide.

In one embodiment, the polymer comprising monomeric units according to structure (I-a) a random copolymer. In another embodiment, the copolymer comprising monomeric units according to structure (I-a) is a block copolymer.

Methods for making suitable vinyl alcohol polymers are known in the art. In one embodiment, a polymer comprising monomeric units according to structure (I-a) is made by polymerizing one or more ethylenically unsaturated monomers, comprising at least one vinyl ester monomer, such vinyl acetate, by known free radical polymerization processes and subsequently hydrolyzing at least a portion of the vinyl ester monomeric units of the polymer to make a polymer having the desired degree of hydrolysis. In another embodiment, the polymer comprising monomeric units according to structure (I-a) is a copolymer made by known controlled free radical polymerization techniques, such as reversible addition fragmentation transfer (RAFT), macromolecular design via interchange of xanthates (MADIX), or atom transfer reversible polymerization (ATRP).

In one embodiment, the vinyl alcohol polymer is made by known solution polymerization techniques, typically in an aliphatic alcohol reaction medium.

In another embodiment, the vinyl alcohol polymer is made by known emulsion polymerization techniques, in the presence of one or more surfactants, in an aqueous reaction medium.

In one embodiment, the vinyl alcohol material comprises a microgel made by crosslinking molecules of a vinyl alcohol polymer.

In one embodiment the vinyl alcohol material comprises a salt, such as a sodium or potassium salt, of a vinyl alcohol polymer.

In one embodiment, the hydrophilizing layer comprises one or more poly(vinyl alcohol) polymers. Poly(vinyl alcohol) polymers are manufactured commercially by the hydrolysis of poly(vinyl acetate). In one embodiment, the poly(vinyl alcohol) has a molecular weight of greater than or equal to about 10,000 (which corresponds approximately to a degree of polymerization of greater than or equal to about 200), more typically from about 20,000 to about 200,000 (which corresponds approximately to a degree of polymerization of from about 400 to about 4000, wherein the term "degree of polymerization" means the number of vinyl alcohol units in the poly(vinyl alcohol) polymer. In one embodiment, the poly(vinyl alcohol) has a degree of hydrolysis of greater than or equal about 50, more typically greater than or equal about 88%.

In one embodiment, the hydrophilizing layer comprises an organophosphorus material (b)(I) and optional vinyl alcohol material (b)(II). For example, some potential weight ratios of these ingredients are as follows based on 100 pbw of the hydrophilizing layer:

from greater than 0 pbw to less than 100 pbw, or from about 0.1 pbw to about 99.9 pbw, or from about 1 pbw to about 99 pbw, organophosphorus material (b)(I), and optionally from greater than 0 pbw to less than 100 pbw, or from about 0.1 pbw to about 99.9 pbw, or from about 1 pbw to about 99 pbw, vinyl alcohol material (b)(II).

Compositions and Methods of use for Laundry Detergents

In addition to the organophosphorus material of the present invention (used as soil release agents for cotton or other fabrics), laundry detergents of the present invention (for washing by hand or in a washing machine) further include adjunct ingredients. A variety of such adjunct laundry detergent ingredients are disclosed by PCT International Publication No. WO 98/39401, incorporated herein by reference in its entirety.

In general, the laundry detergent compositions are solid granules, liquid or gel and comprise a major amount by weight of detergent and a minor amount of the soil release polymer of the present invention. Also, in general the method for washing fabric of the present invention comprises washing a fabric article in a washing medium comprised of a major amount by weight of water and a first minor amount by weight of detergent and a second minor amount by weight of the soil release polymer. Minor amounts of adjunct components may also be present.

I. Aminoalkyl/alkoxysilane-silicone Compounds

One of the adjunct components of the compositions and methods of this invention is an aminosilicone compound, typically an aminosilicone compound of the formula:

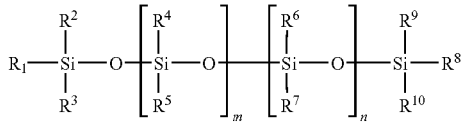

wherein:

$R^1$ and $R^8$ are independently selected from the group consisting of hydrogen, hydroxyl, alkyl (typically $C_1$-$C_4$) and alkoxy (typically $C_1$-$C_4$), $R^2$, $R^3$, $R^9$, and $R^{10}$ are independently selected from the group consisting of alkyl (typically $C_1$-$C_4$) and alkoxy (typically $C_1$-$C_4$), provided that one of $R^2$, $R^3$, $R^9$, and $R^{10}$ may be selected from the group consisting of a primary amino-substituted alkyl group, and a secondary amino-substituted alkyl group (typically an N-(amino-alkyl)-substituted aminoalkyl group such that the compound will have both primary and secondary amine functionality), $R^4$, $R^5$, and $R^6$ are independently selected from the group consisting of alkyl (typically $C_1$-$C_4$) and aryl (typically phenyl), $R^7$ is selected from the group consisting of a primary amino-substituted alkyl group, and a secondary amino-substituted alkyl group (typically an N-(aminoalkyl)-substituted aminoalkyl group such that the compound will have both primary and secondary amine functionality), m and n are numbers wherein m is greater than n (typically the ratio of m:n is from about 2:1 to about 500:1, more typically from about 40:1 to about 300:1 and most typically from about 85:1 to about 185:1) and the sum of n and m yield an aminosilicone compound with a viscosity of about 10 to about 100,000 cps at 25° (typically the sum of n and m is from about 5 to about 600, more typically from about 50 to about 400 and most typically from about 135 to about 275).

The preparation and properties of silicone compounds is discussed generally in *Silicones: Chemistry and Technology*, pp. 21-31 and 75-90 (CRC Press, Vulkan-Verlag, Essen, Germany, 1991) and in Harman et al. "Silicones", *Encyclopedia of Polymer Science and Engineering*, vol. 15, pp. (John Wiley & Sons, Inc. 1989), the disclosures of which are incorporated herein by reference. Preferred aminosilicone compounds are disclosed, for example in JP-047547 (J57161170) (Shinetsu Chem. Ind. KK). Particularly preferred aminosilicone compounds are the three of formula I wherein (1) $R^1$ and $R^8$ are methoxy, $R^2$, $R^3$, $R^4$, $R^5$, $R^6$, $R^9$, and $R^{10}$ are methyl, $R^7$ is N-aminoethyl-3-aminopropyl, m is about 135, and n is about 1.5, (2) $R^1$ and $R^8$ are methoxy, $R^2$, $R^3$, $R^4$, $R^5$, $R^6$, $R^9$, and $R^{10}$ are methyl, $R^7$ is N-aminoethyl-3-aminopropyl, m is about 270, and n is about 1.5, and (3) $R^1$ and $R^8$ are ethoxy, $R^2$, $R^3$, $R^4$, $R^5$, $R^6$, $R^9$, and $R^{10}$ are methyl, $R^7$ is 3-aminopropyl, m is about 135, and n is about 1.5. Other aminosilicone compounds include those wherein $R^1$, $R^2$, and $R^8$ are ethoxy, $R^3$ is 3-aminopropyl, $R^4$, $R^5$, $R^6$, $R^9$, and $R^{10}$ are methyl, m is about 8, and n is zero. Of course, for pure aminosilicone compounds, the numbers m and n will be integers, but for mixtures of compounds, m and n will be expressed as fractions or compound numbers which represent an average of the compounds present. Further, the formula above is not meant to imply a block copolymer structure, thus, the aminosilicone compound may have a random or block structure. Typically, at least about 50% by weight of the $R^4$, $R^5$, and $R^6$ groups will be methyl groups, more typically at least about 90% and even more typically about 100%.

The aminosilicone compound typically will be in the form of a liquid or viscous oil at room temperature.

The aminosilicones described below in the context of the soluble powder detergent compositions can be substituted for the aminosilicones described above.

II. Insoluble Carriers

While the aminosilicone can be used in certain compositions and methods of this invention alone or as an aqueous emulsion, the aminosilicone is preferably used in association with a water-insoluble solid carrier, for example, clays, natural or synthetic silicates, silica, resins, waxes, starches, ground natural minerals, such as kaolins, clays, talc, chalk, quartz, attapulgite, montmorillonite, bentonite or diatomaceous earth, or ground synthetic minerals, such as silica, alumina, or silicates especially aluminum or magnesium silicates. Useful inorganic agents comprise those of natural or synthetic mineral origin. Specific examples of carriers include diatomaceous earths, e.g. Celite™ (Johns Manville Corp., Denver, Col.) and the smectite clays such as the saponites and the montmorillonite colloidal clays such as Veegum™ and Van Gel™ (Vanderbilt Minerals, Murray, Ky.), or Magnabrite™ (American Colloid Co., Skokie, Ill.). Synthetic silicate carriers include the hydrous calcium silicate, Micro-Cel™ and the hydrous magnesium silicate Celkate™ (Seegot, Inc., Parsippany, N.J.). Inosilicates carriers such as the naturally-occurring calcium meta-silicates such as wollastonite, available as the NYAD™ wollastonite series (Processed Minerals Inc., Willsboro, N.Y.) can also be mentioned. Synthetic sodium magnesium silicate clays, hectorite clays, and fumed silicas can also be mentioned as carriers. The carrier can be a very finely divided material of average particle diameter below 0.1 micron. Examples of such carriers are fumed silica and precipitated silica; these generally have a specific surface (BET) of above 40 $m^2/g$.

The clays that are particularly useful elements of the compositions and methods of this invention are those which cooperate with the silicone compounds to wash laundry better than would be expected from the actions of the individual components in detergent compositions. Such clays include the montmorillonite-containing clays which have swelling properties (in water) and which are of smectite structure. Typical of the smectite clays for use in the present invention is bentonite and typically the best of the bentonites are those which have a substantial swelling capability in water, such as the sodium bentonites, the potassium bentonites, or which are swellable in the presence of sodium or potassium ions, such as calcium bentonite. Such swelling bentonites are also known as western or Wyoming bentonites, which are essentially sodium bentonite. Other bentonites, such as calcium bentonite, are normally non-swelling. Among the preferred bentonites are those of sodium and potassium, which are normally swelling, and calcium and magnesium, which are normally non-swelling, but are swellable. Of these it is preferred to utilize calcium (with a source of sodium being present) and sodium bentonites. The bentonites employed are not limited to those produced in the United States of America, such as Wyoming bentonite, but also may be obtained from Europe, including Italy and Spain, as calcium bentonite, which may be converted to sodium bentonite by treatment with sodium carbonate, or may be employed as calcium bentonite. Typically, the clay will have a high montmorillonite content and a low content of cristobalite and/or quartz. Also, other montmorillonite-containing smectite clays of properties like those of the bentonites described may be substituted in whole or in part for the bentonites described herein, but typically the clay will be a sodium bentonite with high montmorillonite content and low cristobalite and quartz contents.

The swellable bentonites and similarly operative clays are of ultimate particle sizes in the micron range, e.g., 0.01 to 20 microns and of actual particle sizes less than 100 or 150 microns, such as 40 to 150 microns or 45 to 105 microns. Such size ranges also apply to the zeolite builders, which will be described later herein. The bentonite and other such suitable swellable clays may be agglomerated to larger particle sizes too, such as up to 2 or 3 mm. in diameter.

The ratio of aminosilicone compound to carrier will typically range from about 0.001 to about 2, more typically from about 0.02 to about 0.5, and most typically from about 0.1 to about 0.3.

III. Detergents

The methods and compositions of this laundry detergent invention all employ a detergent, and optionally, other functional ingredients. Examples of the detergents and other functional ingredients that can be used are disclosed in U.S. Ser. No. 08/726,437, filed Oct. 4, 1996, the disclosure of which is incorporated herein by reference. The detergent can be selected from a wide variety of surface active agents.

A. Nonionic Surfactants

Nonionic surfactants, including those having an HLB of from 5 to 17, are well known in the detergency art. Examples of such surfactants are listed in U.S. Pat. No. 3,717,630, Booth, issued Feb. 20, 1973, and U.S. Pat. No. 3,332,880, Kessler et al., issued Jul. 25, 1967, each of which is incorporated herein by reference. Nonlimiting examples of suitable nonionic surfactants which may be used in the present invention are as follows:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, said ethylene oxide being present in an amount equal to 5 to 25 moles of ethylene oxide per mole of alkyl phenol. The alkyl substituent in such compounds can be derived, for example, from polymerized propylene, diisobutylene, and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal CO-630, marketed by Rhodia, Inc. and Triton X-45, X-114, X-100, and X-102, all marketed by Union Carbide.

(2) The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol; and the condensation product of about 9 moles of ethylene oxide with coconut alcohol (a mixture of fatty alcohols with alkyl chains varying in length from 10 to 14 carbon atoms). Examples of commercially available nonionic surfactants in this type include Tergitol 15-S-9, marketed by Union Carbide Corporation, Neodol 45-9, Neodol 23-6.5, Neodol 45-7, and Neodol 45-4, marketed by Shell Chemical Company.

(3) The condensation products of ethylene oxide with a hydrophobic base formed by the condensation of propylene oxide with propylene glycol. The hydrophobic portion of these compounds typically has a molecular weight of from about 1500 to 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants, marketed by Wyandotte Chemical Corporation.

(4) The condensation products of ethylene oxide with the product resulting from the reaction of propylene oxide and ethylenediamine. The hydrophobic moiety of these products consists of the reaction product of ethylenediamine and excess propylene oxide, said moiety having a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

(5) Semi-polar nonionic detergent surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbons atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred semi-polar nonionic detergent surfactants are the amine oxide detergent surfactants having the formula

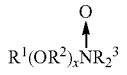

wherein $R^1$ is an alkyl, hydroxy alkyl, or alkyl phenyl group or mixtures thereof containing from about 8 to about 22 carbon atoms. $R^2$ is an alkylene or hydroxy alkylene group containing from 2 to 3 carbon atoms or mixtures thereof, x is from 0 to about 3 and each $R^3$ is an alkyl or hydroxy alkyl group containing from 1 to about 3 carbon atoms or a polyethylene oxide group containing from one to about 3 ethylene oxide groups and said $R^3$ groups can be attached to each other, e.g., through an oxygen or nitrogen atom to form a ring structure.

Preferred amine oxide detergent surfactants are $C_{10}$-$C_{18}$ alkyl dimethyl amine oxide, $C_8$-$C_{18}$ alkyl dihydroxy ethyl amine oxide, and $C_{8-12}$ alkoxy ethyl dihydroxy ethyl amine oxide.

Nonionic detergent surfactants (1)-(4) are conventional ethoxylated nonionic detergent surfactants and mixtures thereof can be used.

Preferred alcohol ethoxylate nonionic surfactants for use in the compositions of the liquid, powder, and gel applications are biodegradable and have the formula $$R(OC_2H_4)_nOH$$

wherein R is a primary or secondary alkyl chain of from about 8 to about 22, preferably from about 10 to about 20 carbon atoms and n is an average of from about 2 to about 12, particularly from about 2 to about 9. The nonionics have an HLB (hydrophilic-lipophilic balance) of from about 5 to about 17, preferably from about 6 to about 15. HLB is defined in detail in Nonionic Surfactants, by M. J. Schick, Marcel Dekker, Inc., 1966, pages 606-613, incorporated herein by reference. In preferred nonionic surfactants, n is from 3 to 7. Primary linear alcohol ethoxylates (e.g., alcohol ethoxylates produced from organic alcohols which contain about 20% 2-methyl branched isomers, commercially available from Shell Chemical Company under the trademark Neodol) are preferred from a performance standpoint.

Particularly preferred nonionic surfactants for use in liquid, powder, and gel applications include the condensation product of $C_{10}$ alcohol with 3 moles of ethylene oxide; the condensation product of tallow alcohol with 9 moles of ethylene oxide; the condensation product of coconut alcohol with 5 moles of ethylene oxide; the condensation product of coconut alcohol with 6 moles of ethylene oxide; the condensation product of $C_{12}$ alcohol with 5 moles of ethylene oxide; the condensation product of $C_{12-13}$ alcohol with 6.5 moles of ethylene oxide, and the same condensation product which is stripped so as to remove substantially all lower ethoxylate and nonethoxylated fractions; the condensation product of $C_{12-13}$ alcohol with 2.3 moles of ethylene oxide, and the same condensation product which is stripped so as to remove substantially all lower ethoxylated and nonethoxylated fractions; the condensation product of $C_{12-13}$ alcohol with 9 moles of ethylene oxide; the condensation product of $C_{14-15}$ alcohol with 2.25 moles of ethylene oxide; the condensation product of $C_{14-15}$ alcohol with 4 moles of ethylene oxide; the condensation product of $C_{14-15}$ alcohol with 7 moles of ethylene oxide; and the condensation product of $C_{14-15}$ alcohol with 9 moles of ethylene oxide. For bar soap applications, nonionic surfactants are preferably solids at room temperature with a melting point above about 25° C., preferably above about 30° C. Bar compositions of the present invention made with lower melting nonionic surfactants are generally too soft, not meeting the bar firmness requirements of the present invention.

Also, as the level of nonionic surfactant increases, i.e., above about 20% by weight of the surfactant, the bar can generally become oily.

Examples of nonionic surfactants usable herein, but not limited to bar applications, include fatty acid glycerine and polyglycerine esters, sorbitan sucrose fatty acid esters, polyoxyethylene alkyl and alkyl allyl ethers, polyoxyethylene lanolin alcohol, glycerine and polyoxyethylene glycerine fatty acid esters, polyoxyethylene propylene glycol and sorbitol fatty acid esters, polyoxyethylene lanolin, castor oil or hardened castor oil derivatives, polyoxyethylene fatty acid amides, polyoxyethylene alkyl amines, alkylpyrrolidone, glucamides, alkylpolyglucosides, and mono- and dialkanol amides.

Typical fatty acid glycerine and polyglycerine esters, as well as typical sorbitan sucrose fatty acid esters, fatty acid amides, and polyethylene oxide/polypropylene oxide block copolymers are disclosed by U.S. Pat. No. 5,510,042, Hartman et al, incorporated herein by reference.

The castor oil derivatives are typically ethoxylated castor oil. It is noted that other ethoxylated natural fats, oils or waxes are also suitable.

Polyoxyethylene fatty acid amides are made by ethoxylation of fatty acid amides with one or two moles of ethylene oxide or by condensing mono- or diethanol amines with fatty acid.

Polyoxyethylene alkyl amines include those of formula: $RNH—(CH_2CH_2O)_n—H$, wherein R is $C_6$ to $C_{22}$ alkyl and n is from 1 to about 100.

Monoalkanol amides include those of formula: $RCONHR^1OH$, wherein R is $C_6$-$C_{22}$ alkyl and $R^1$ is $C_1$ to $C_6$ alkylene. Dialkanol amides are typically mixtures of:

diethanolamide: $RCON(CH_2CH_2OH)_2$;
amide ester: $RCON(CH_2CH_2OH)—CH_2CH_2OOCR$;
amine ester: $RCOOCH_2CH_2NHCH_2CH_2OH$; and
amine soap: $RCOOH_2N(CH_2CH_2OH)_2$, wherein R in the above formulas is an alkyl of from 6 to 22 carbon atoms.

Examples of preferred but not limiting surfactants for detergent bar products are the following:

Straight-Chain Primary Alcohol Alkoxylates

The deca-, undeca-, dodeca-, tetradeca-, and pentadeca-ethoxylates of n-hexadecanol, and n-hexadecanol, and n-octadecanol having an HLB within the range recited herein are useful nonionics in the context of this invention. Exemplary ethoxylated primary alcohols useful herein as the conventional nonionic surfactants of the compositions are n-$C_{18}$EO (10); n-$C_{14}$EO(13); and n-$C_{10}$EO(11). The ethoxylates of mixed natural or synthetic alcohols in the "tallow" chain length range are also useful herein. Specific examples of such materials include tallow-alcohol-EO(11), tallow-alcohol-EO (18), and tallow-alcohol-EO(25).

Straight-Chain Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful conventional nonionics in the context of this invention. Exemplary ethoxylated secondary alcohols useful herein are 2-$C_{16}$EO(11); 2-$C_{20}$EO(11); and 2-$C_{16}$EO(14).

Alkyl Phenol Alkoxylates

As in the case of the alcohol alkoxylates, the hexa- through octadeca-ethoxylates of alkylated phenols, particularly monohydric alkylphenols, having an HLB within the range recited herein are useful as conventional nonionic surfactants in the instant compositions. The hexa- through octadeca-ethoxylates of p-tridecylphenol, m-pentadecylphenol, and the like, are useful herein. Exemplary ethoxylated alkylphenols useful in the mixtures herein are: p-tridecylphenol EO(11) and p-pentadecylphenol EO(18). Especially preferred is Nonyl Nonoxynol-49 known as Igepal® DM-880 from Rhodia, Inc.

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

Olefinic Alkoxylates

The alkenyl alcohols, both primary and secondary, and alkenyl phenols corresponding to those disclosed immediately hereinabove can be ethoxylated to an HLB within the range recited herein and used as the conventional nonionic surfactants of the instant compositions.

Branched Chain Alkoxylates

Branched chain primary and secondary alcohols which are available can be ethoxylated and employed as conventional nonionic surfactants in compositions herein.

The above ethoxylated nonionic surfactants are useful in the present compositions alone or in combination, and the term "nonionic surfactant" encompasses mixed nonionic surface active agents.

Alkylpolysaccharides

Still further suitable nonionic surfactants of this invention include alkylpolysaccharides, preferably alkylpolyglycosides of the formula:

$$RO(C_nH_{2n}O)_t(Z)_x$$

wherein

Z is derived from glycose;

R is a hydrophobic group selected from the group consisting of a $C_{10}$-$C_{18}$, preferably a $C_{12}$-$C_{14}$, alkyl group, alkyl phenyl group, hydroxyalkyl group, hydroxyalkylphenyl group, and mixtures thereof;

n is 2 or 3; preferably 2;

t is from 0 to 10; preferably 0; and x is from 1.5 to 8; preferably 1.5 to 4; more preferably from 1.6 to 2.7.

These surfactants are disclosed in U.S. Pat. No. 4,565,647, Llenado, issued Jan. 21, 1986; U.S. Pat. No. 4,536,318, Cook et al., issued Aug. 20, 1985; U.S. Pat. No. 4,536,317, Llenado et al., issued Aug. 20, 1985; U.S. Pat. No. 4,599,188 Llenado, issued Jul. 8, 1986; and U.S. Pat. No. 4,536,319, Payne, issued Aug. 20, 1985; all of which are incorporated herein by reference.

The compositions of the present invention can also comprise mixtures of the above nonionic surfactants.

A thorough discussion of nonionic surfactants for detergent bar and liquid products is presented by U.S. Pat. No. 5,510,042, Hartman et al., and U.S. Pat. No. 4,483,779, Llenado, et al., incorporated herein by reference.

B. Anionic Surfactants

Anionic surfactants include any of the known hydrophobes attached to a carboxylate, sulfonate, sulfate or phosphate polar, solubilizing group including salts. Salts may be the sodium, potassium, ammonium and amine salts of such surfactants. Useful anionic surfactants can be organic sulfuric reaction products having in their molecular structure an alkyl group containing from about 8 to about 22 carbon atoms and a sulfonic acid or sulfuric acid ester group, or mixtures thereof. (Included in the term "alkyl" is the alkyl portion of acyl groups.) Examples of this group of synthetic detersive surfactants which can be used in the present invention are the alkyl sulfates, especially those obtained by sulfating the higher alcohols ($C_8$-$C_{18}$ carbon atoms) produced from the glycerides of tallow or coconut oil; and alkyl benzene sulfonates.

Other useful anionic surfactants herein include the esters of alpha-sulfonated fatty acids preferably containing from about 6 to 20 carbon atoms in the ester group; 2-acyloxyalkane-1-sulfonic acids preferably containing from about 2 to 9 carbon atoms in the acyl group and from about 9 to about 23 carbon atoms in the alkane moiety; alkyl ether sulfates preferably containing from about 10 to 20 carbon atoms in the alkyl group and from about 1 to 30 moles of ethylene oxide; olefin sulfonates preferably containing from about 12 to 24 carbon atoms; and beta-alkyloxy alkane sulfonates preferably containing from about 1 to 3 carbon atoms in the alkyl group and from about 8 to 20 carbon atoms in the alkane moiety.

Anionic surfactants based on the higher fatty acids, i.e., "soaps" are useful anionic surfactants herein. Higher fatty acids containing from about 8 to about 24 carbon atoms and preferably from about 10 to about 20 carbon atoms and the coconut and tallow soaps can also be used herein as corrosion inhibitors.

Preferred water-soluble anionic organic surfactants herein include linear alkyl benzene sulfonates containing from about 10 to about 18 carbon atoms in the alkyl group; branched alkyl benzene sulfonates containing from about 10 to about 18 carbon atoms in the alkyl group; the tallow range alkyl sulfates; the coconut range alkyl glyceryl sulfonates; alkyl ether (ethoxylated) sulfates wherein the alkyl moiety contains from about 12 to 18 carbon atoms and wherein the average degree of ethoxylation varies between 1 and 12, especially 3 to 9; the sulfated condensation products of tallow alcohol with from about 3 to 12, especially 6 to 9, moles of ethylene oxide; and olefin sulfonates containing from about 14 to 16 carbon atoms.

Specific preferred anionics for use herein include: the linear $C_{10}$-$C_{14}$ alkyl benzene sulfonates (LAS); the branched $C_{10}$-$C_{14}$ alkyl benzene sulfonates (ABS); the tallow alkyl sulfates, the coconut alkyl glyceryl ether sulfonates; the sulfated condensation products of mixed $C_{10}$-$C_{18}$ tallow alcohols with from about 1 to about 14 moles of ethylene oxide; and the mixtures of higher fatty acids containing from 10 to 18 carbon atoms.

It is to be recognized that any of the foregoing anionic surfactants can be used separately herein or as mixtures. Moreover, commercial grades of the surfactants can contain non-interfering components which are processing by-products. For example, commercial alkaryl sulfonates, preferably $C_{10}$-$C_{14}$, can comprise alkyl benzene sulfonates, alkyl toluene sulfonates, alkyl naphthalene sulfonates and alkyl polybenzenoid sulfonates. Such materials and mixtures thereof are fully contemplated for use herein.

Other examples of the anionic surfactants used herein include fatty acid soaps, ether carboxylic acids and salts thereof, alkane sulfonate salts, a-olefin sulfonate salts, sulfonate salts of higher fatty acid esters, higher alcohol sulfate ester or ether ester salts, alkyl, preferably higher alcohol phosphate ester and ether ester salts, and condensates of higher fatty acids and amino acids.

Fatty acid soaps include those having the formula: R—C(O)OM, wherein R is $C_6$ to $C_{22}$ alkyl and M is preferably sodium.

Salts of ether carboxylic acids and salts thereof include those having the formula: $R—(OR^1)_n—OCH_2C(O)OM$, wherein R is $C_6$ to $C_{22}$ alkyl, $R^1$ is $C_2$ to $C_{10}$, preferably $C_2$ alkyl, and M is preferably sodium.

Alkane sulfonate salts and alpha-olefin sulfonate salts have the formula: $R—SO_3M$, wherein R is $C_6$ to $C_{22}$ alkyl or alpha-olefin, respectively, and M is preferably sodium.

Sulfonate salts of higher fatty acid esters include those having the formula:

$$RC(O)O—R^1—SO_3M,$$

wherein R is $C_{12}$ to $C_{22}$ alkyl, $R^1$ is $C_1$ to $C_{18}$ alkyl and M is preferably sodium.

Higher alcohol sulfate ester salts include those having the formula:

$$RC(O)O—R^1—OSO_3M,$$

wherein R is $C_{12}$-$C_{22}$ alkyl, $R^1$ is $C_1$-$C_{18}$ hydroxyalkyl, M is preferably sodium.

Higher alcohol sulfate ether ester salts include those having the formula:

$$RC(O)(OCH_2CH_2)_x—R^1—OSO_3M,$$

wherein R is $C_{12}$-$C_{22}$ alkyl, $R^1$ is $C_1$-$C_{18}$ hydroxyalkyl, M is preferably sodium and x is an integer from 5 to 25.

Higher alcohol phosphate ester and ether ester salts include compounds of the formulas:

$$R—(OR^1)_n—OPO(OH)(OM);$$

$$(R—(OR^1)_n—O)_2PO(OM); \text{ and}$$

$$(R—(OR^1)_n—O)_3—PO,$$

wherein R is alkyl or hydroxyalkyl of 12 to 22 carbon atoms, $R^1$ is $C_2H_4$, n is an integer from 5 to 25, and M is preferably sodium.

Other anionic surfactants herein are sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

C. Cationic Surfactants

Preferred cationic surfactants of the present invention are the reaction products of higher fatty acids with a polyamine selected from the group consisting of hydroxyalkylalkylenediamines and dialkylenetriamines and mixtures thereof.

A preferred component is a nitrogenous compound selected from the group consisting of:

(i) the reaction product mixtures of higher fatty acids with hydroxyalkylalkylenediamines in a molecular ratio of about 2:1, said reaction product containing a composition having a compound of the formula:

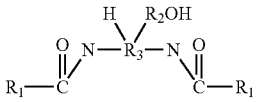

wherein $R_1$ is an acyclic aliphatic $C_{15}$-$C_{21}$ hydrocarbon group and $R_2$ and $R_3$ are divalent $C_1$-$C_3$ alkylene groups; commercially available as MAZAMIDE 6 from PPG;

(ii) the reaction product of higher fatty acids with dialkylenetriamines in a molecular ratio of about 2:1; said reaction product containing a composition having a compound of the formula:

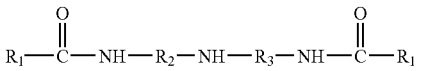

wherein $R_1$, $R_2$ and $R_3$ are as defined above; and mixtures thereof.

Another preferred component is a cationic nitrogenous salt containing one long chain acyclic aliphatic $C_{15}$-$C_{22}$ hydrocarbon group selected from the group consisting of:

(i) acyclic quaternary ammonium salts having the formula:

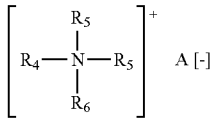

wherein $R_4$ is an acyclic aliphatic $C_{15}$-$C_{22}$ hydrocarbon group, $R_5$ and $R_6$ are $C_1$-$C_4$ saturated alkyl or hydroxyalkyl groups, and A [-] is an anion, especially as described in more detail hereinafter, examples of these surfactants are sold by Sherex Chemical Company under the ADGEN trademarks;

(ii) substituted imidazolinium salts having the formula:

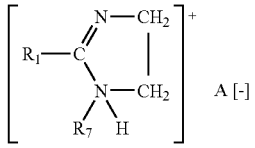

wherein $R_1$ is an acyclic aliphatic $C_{15}$-$C_{21}$ hydrocarbon group, $R_7$ is a hydrogen or a $C_1$-$C_4$ saturated alkyl or hydroxyalkyl group, and A [-] is an anion;

(iii) substituted imidazolinium salts having the formula:

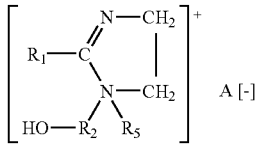

wherein $R_2$ is a divalent $C_1$-$C_3$ alkylene group and $R_1$, $R_5$ and A [-] are as defined above; an example of which is commercially available under the Monaquat ISIES trademark from Mona Industries, Inc.;

(iv) alkylpyridinium salts having the formula:

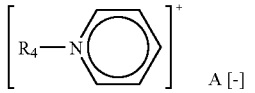

wherein $R_4$ is an acyclic aliphatic $C_{16}$-$C_{22}$ hydrocarbon group and A [-] is an anion; and (v) alkanamide alkylene pyridinium salts having the formula:

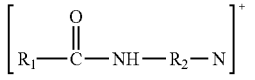

wherein $R_1$ is an acyclic aliphatic $C_{15}$-$C_{21}$ hydrocarbon group, $R_2$ is a divalent $C_1$-$C_3$ alkylene group, and A [-] is an ion group; and mixtures thereof.

Another class of preferred cationic nitrogenous salts having two or more long chain acyclic aliphatic $C_{15}$-$C_{22}$ hydrocarbon groups or one said group and an arylalkyl group are selected from the group consisting of:

(i) acyclic quaternary ammonium salts having the formula:

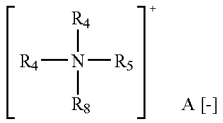

wherein each $R_4$ is an acyclic aliphatic $C_{15}$-$C_{22}$ hydrocarbon group, $R_5$ is a $C_1$-$C_4$ saturated alkyl or hydroxyalkyl group, $R_8$ is selected from the group consisting of $R_4$ and $R_5$ groups, and A [-] is an anion defined as above; examples of which are commercially available from Sherex Company under the Adgen trademarks;

(ii) diamido quaternary ammonium salts having the formula:

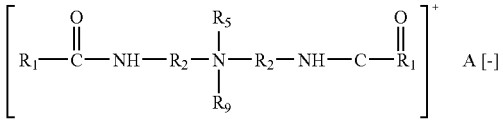

wherein each $R_1$ is an acyclic aliphatic $C_{15}$-$C_{21}$ hydrocarbon group, $R_2$ is a divalent alkylene group having 1 to 3 carbon atoms, $R_5$ and $R_9$ are $C_1$-$C_4$ saturated alkyl or hydroxyalkyl groups, and A [-] is an anion; examples of which are sold by Sherex Chemical Company under the VARISOFT trademark;

(iii) diamino alkoxylated quaternary ammonium salts having the formula:

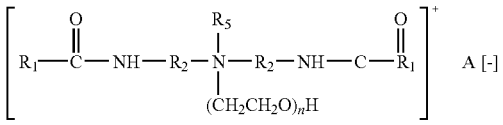

wherein n is equal to 1 to about 5, and $R_1$, $R_2$, $R_5$ and A [-] are as defined above;

(iv) quaternary ammonium compounds having the formula:

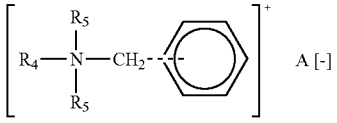

wherein each $R_4$ is an acyclic aliphatic $C_{15}$-$C_{22}$ hydrocarbon group, each $R_5$ is a $C_1$-$C_4$ saturated alkyl or hydroxyalkyl group, and A [-] is an anion; examples of such surfactants are available from Onyx Chemical Company under the Ammonyx® 490 trademark;

(v) substituted imidazolinium salts having the formula:

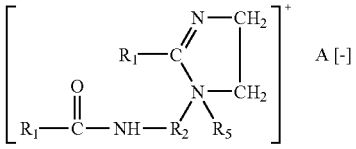

wherein each $R_1$ is an acyclic aliphatic $C_{15}$-$C_{21}$ hydrocarbon group, $R_2$ is a divalent alkylene group having 1 to 3 carbon atoms, and $R_5$ and A [-] are as defined above; examples are commercially available from Sherex Chemical Company under the Varisoft 475 and Varisoft 445 trademarks; and (vi) substituted imidazolinium salts having the formula:

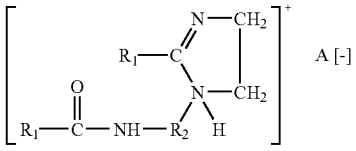

wherein $R_1$, $R_2$ and A—are as defined above; and mixtures thereof.

The more preferred cationic conventional surfactant is selected from the group consisting of an alkyltrimethylammonium salt, a dialkyldimethylammonium salt, an alkyldimethylbenzylammonium salt, an alkylpyridinium salt, an alkylisoquinolinium salt, benzethonium chloride, and an acylamino acid cationic surfactant.

Anion A

In the cationic nitrogenous salts herein, the anion A [-] provides electrical neutrality. Most often, the anion used to provide electrical neutrality in these salts is a halide, such as chloride, bromide, or iodide. However, other anions can be used, such as methylsulfate, ethylsulfate, acetate, formate, sulfate, carbonate, and the like. Chloride and methylsulfate are preferred herein as anion A.

Cationic surfactants are commonly employed as fabric softeners in compositions added during the rinse cycle of clothes washing. Many different types of fabric conditioning agents have been used in rinse cycle added fabric conditioning compositions as disclosed by U.S. Pat. No. 5,236,615, Trinh et al. and U.S. Pat. No. 5,405,542, Trinh et al., both patents herein incorporated by reference in their entirety. The most favored type of agent has been the quaternary ammonium compounds. Many such quaternary ammonium compounds are disclosed for example, by U.S. Pat. No. 5,510,042, Hartman et al. incorporated herein by reference in its entirety. These compounds may take the form of noncyclic quaternary ammonium salts having preferably two long chain alkyl groups attached to the nitrogen atoms. Additionally, imidazolinium salts have been used by themselves or in combination with other agents in the treatment of fabrics as disclosed by U.S. Pat. No. 4,127,489, Pracht, et al., incorporated herein by reference in its entirety. U.S. Pat. No. 2,874,074, Johnson discloses using imidazolinium salts to condition fabrics; and U.S. Pat. No. 3,681,241, Rudy, and U.S. Pat. No. 3,033,704, Sherrill et al. disclose fabric conditioning compositions containing mixtures of imidazolinium salts and other fabric conditioning agents. These patents are incorporated herein by reference in their entirety.

D. Amphoteric Surfactants

Amphoteric surfactants have a positive or negative charge or both on the hydrophilic part of the molecule in acidic or alkaline media.

Examples of the amphoteric surfactants which can be used herein include amino acid, betaine, sultaine, phosphobetaines, imidazolinium derivatives, soybean phospholipids, and yolk lecithin. Examples of suitable amphoteric surfactants include the alkali metal, alkaline earth metal, ammonium or substituted ammonium salts of alkyl amphocarboxy glycinates and alkyl amphocarboxypropionates, alkyl amphodipropionates, alkyl amphodiacetates, alkyl amphoglycinates and alkyl amphopropionates wherein alkyl represents an alkyl group having 6 to 20 carbon atoms. Other suitable amphoteric surfactants include alkyliminopropionates, alkyl iminodipropionates and alkyl amphopropylsulfonates having between 12 and 18 carbon atoms, alkylbetaines and amidopropylbetaines and alkylsultaines and alkylamidopropylhydroxy sultaines wherein alkyl represents an alkyl group having 6 to 20 carbon atoms are especially preferred.

Particularly useful amphoteric surfactants include both mono and dicarboxylates such as those of the formulae:

(A)

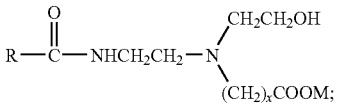

(B)

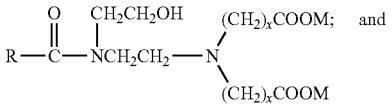

and (C)

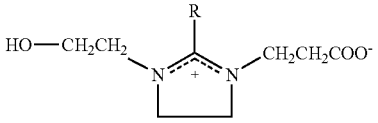

wherein R is an alkyl group of 6-20 carbon atoms, x is 1 or 2 and M is hydrogen or sodium. Mixtures of the above structures are particularly preferred.

Other formulae for the above amphoteric surfactants include the following:

Alkyl betaines (D)

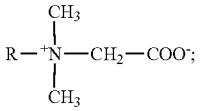

Amidopropyl betaines (E)

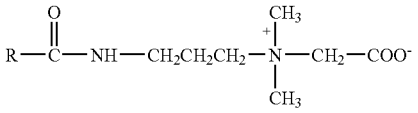

Alkyl sultaines

-continued (F)

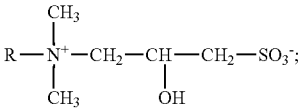

and

Alkyl amidopropylhydroxy sultaines (G)

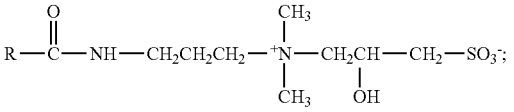

where R is an alkyl group of 6-20 carbon atoms and M is hydrogen or sodium.

Of the above amphoteric surfactants, particularly preferred are the alkali salts of alkyl amphocarboxyglycinates and alkyl amphocarboxypropionates, alkyl amphodipropionates, alkyl amphodiacetates, alkyl amphoglycinates, alkyl amphopropyl sulfonates and alkyl amphopropionates wherein alkyl represents an alkyl group having 6 to 20 carbon atoms. Even more preferred are compounds wherein the alkyl group is derived from coconut oil or is a lauryl group, for example, cocoamphodipropionate. Such cocoamphodipropionate surfactants are commercially sold under the trademarks MIRANOL C2M-SF CONC. and MIRANOL FBS by Rhodia, Inc.

Other commercially useful amphoteric surfactants are available from Rhodia, Inc. and include:

| |
|---|
| cocoamphoacetate (sold under the trademarks MIRANOL CM CONC. and MIRAPON FA), |
| cocoamphopropionate (sold under the trademarks MIRANOL CM-SF CONC. and MIRAPON FAS), |
| cocoamphodiacetate (sold under the trademarks MIRANOL C2M CONC. and MIRAPON FB), |
| lauroamphoacetate (sold under the trademarks MIRANOL HM CONC. and MIRAPON LA), |
| lauroamphodiacetate (sold under the trademarks MIRANOL H2M CONC. and MIRAPON LB), |
| lauroamphodipropionate (sold under the trademarks MIRANOL H2M SF CONC. AND MIRAPON LBS), |
| lauroamphodiacetate obtained from a mixture of lauric and myristic acids (sold under the trademark MIRANOL BM CONC.), and |

Other useful amphoteric surfactants are:

| |
|---|
| caproamphodiacetate (sold under the trademark MIRANOL S2M CONC.), |
| caproamphoacetate (sold under the trademark MIRANOL SM CONC.), |
| caproamphodipropionate (sold under the trademark MIRANOL S2M-SF CONC.), and |
| stearoamphoacetate (sold under the trademark MIRANOL DM). |
| cocoamphopropyl sulfonate |

E. Gemini Surfactants

Gemini surfactants form a special class of surfactant. These surfactants have the general formula:

$$A\text{-}G\text{-}A^1$$

and get their name because they comprise two surfactant moieties ($A,A^1$) joined by a spacer (G), wherein each surfactant moiety (A,A,[1]) has a hydrophilic group and a hydrophobic group. Generally, the two surfactant moieties (A,A[1]) are twins, but they can be different.

The gemini surfactants are advantageous because they have low critical micelle concentrations (cmc) and, thus, lower the cmc of solutions containing both a gemini surfactant and a conventional surfactant. Lower cmc causes better solubilization and increased detergency at lower surfactant use levels and unexpectedly enhances the deposition of the soil release polymers as claimed by this invention with demonstrated results to follow herein. Soil removal agents adhere to the fabric being laundered, much better than when mixed with only non-gemini, conventional surfactants.

Also, the gemini surfactants result in a low $pC_{20}$ value and low Krafft points. The $pC_{20}$ value is a measure of the surfactant concentration in the solution phase that will reduce the surface tension of the solvent by 20 dynes/cm. It is a measure of the tendency of the surfactant to adsorb at the surface of the solution. The Krafft point is the temperature at which the surfactant's solubility equals the cmc. Low Krafft points imply better solubility in water, and lead to greater latitude in making formulations.

A number of the gemini surfactants are reported in the literature, see for example, Okahara et al., J. Japan Oil Chem. Soc. 746 (Yukagaku) (1989); Zhu et al., 67 JAOCS 7,459 (July 1990); Zhu et al., 68 JAOCS 7,539 (1991); Menger et al., J. Am. Chemical Soc. 113,1451 (1991); Masuyama et al., 41 J. Japan Chem. Soc. 4,301 (1992); Zhu et al., 69 JAOCS 1,30 (January 1992); Zhu et al., 69 JAOCS 7,626 July 1992); Menger et al., 115 J. Am. Chem. Soc. 2, 10083 (1993); Rosen, Chemtech 30 (March 1993); and Gao et al., 71 JAOCS 7,771 (July 1994), all of this literature incorporated herein by reference.

Also, gemini surfactants are disclosed by U.S. Pat. No. 2,374,354, Kaplan; U.S. Pat. No. 2,524,218, Bersworth; U.S. Pat. No. 2,530,147 Bersworth (two hydrophobic tails and three hydrophilic heads); U.S. Pat. No. 3,244,724, Guttmann; U.S. Pat. No. 5,160,450, Okahara, et al., all of which are incorporated herein by reference.

The gemini surfactants may be anionic, nonionic, cationic or amphoteric. The hydrophilic and hydrophobic groups of each surfactant moiety (A,A[1]) may be any of those known to be used in conventional surfactants having one hydrophilic group and one hydrophobic group.

For example, a typical nonionic gemini surfactant, e.g., a bis-polyoxyethylene alkyl ether, would contain two polyoxyethylene alkyl ether moieties.

Each moiety would contain a hydrophilic group, e.g., polyethylene oxide, and a hydrophobic group, e.g., an alkyl chain.

Gemini surfactants specifically useful in the present invention include gemini anionic or nonionic surfactants of the formulae:

II

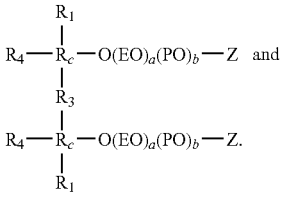

-continued

III

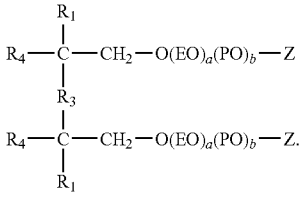

wherein $R_c$ represents aryl, preferably phenyl. $R_1$, $R_3$, $R_4$, Y, Z, a and b are as defined above. More specifically, these compounds comprise:

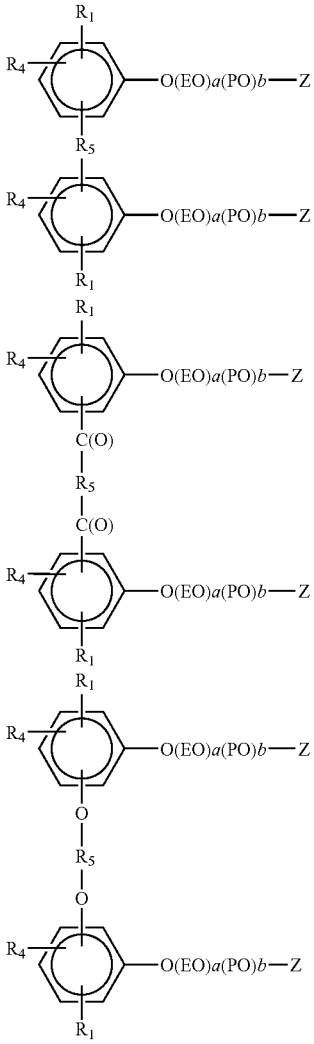

wherein $R_1$, $R_4$, $R_5$, Z, a, and b are as defined hereinbefore.

The primary hydroxyl group of these surfactants can be readily phosphated, sulfated or carboxylated by standard techniques.

The compounds included in Formula II can be prepared by a variety of synthetic routes. For instance, the compounds of Formula IV can be prepared by condensing a monoalkyl phenol with paraformaldehyde in the presence of an acid catalyst such as acetic acid. The compounds of Formula V can be synthesized by a Lewis acid catalyzed reaction of an alkylphenol with a dicarboxylic acid, e.g., terephthalic acid.

The compounds of Formula II are more fully described in U.S. Pat. No. 5,710,121 filed Dec. 20, 1996, the entire disclosure of which is incorporated herein by reference.

A class of gemini surfactants that can be used in providing the improved emulsions which are operable at lower concentrations as disclosed in the present invention include a group of amphoteric, and cationic quaternary surfactants comprising compounds of the formula:

VII

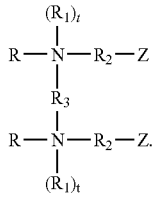

wherein R, t, and Z are as defined hereinbefore. $R_1$ is as defined before and includes the $[-(EO)_a(PO)_bO—]H$ moiety. $R_2$ is as defined before, however, D includes the following moieties: $—N(R_6)—C(O)—R_5—CH_2O—$ and $—N(R_6)—C(O)—R_5—N(R_6)—R_4—$. When t is zero, the compounds are amphoteric and when t is 1, the compounds are cationic quaternary compounds. $R_3$ is selected from the group consisting of a bond, $C_1$-$C_{10}$ alkyl, and $—R_8$-$D_1$-$R_8—$ wherein $D_1$, $R_5$, $R_6$, a, b, and $R_8$ are as defined above (except $R_8$ is not $—OR_5O—$).

Preferably, the compounds of Formula VII comprise:

VIII

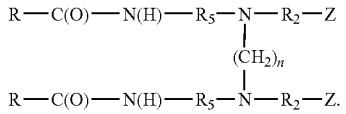

wherein R, $R_2$, $R_5$ and Z are as defined above and n equals a number from about 2 to about 10.

More particularly, the compounds of Formula VII comprise:

IX

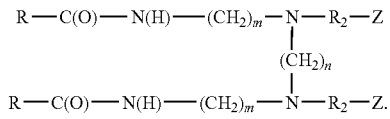

wherein R, $R_2$, $R_5$, Z, and n are as defined hereinbefore; and m independently equals a number between about 2 and about 10.

Representative compounds of Formula VII include:

X

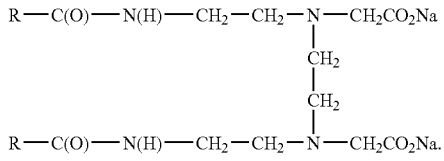

-continued

XI

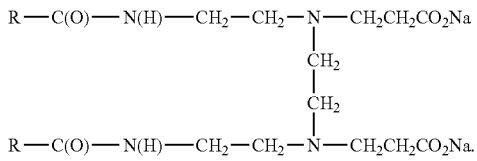

XII

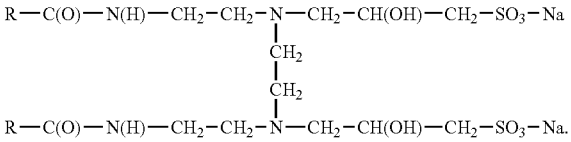

While the compounds of Formulae VII-XII can be prepared by a variety of synthetic routes, it has been found that they can be produced particularly effectively by a process which utilizes a polyamine reactant having at least four amino groups of which two are terminal primary amines such as triethylene tetramine. These processes are more fully set forth in copending application "Amphoteric Surfactants Having Multiple Hydrophobic and Hydrophilic Groups", U.S. Ser. No. 08/292,993 filed Aug. 19, 1994, the entire disclosure of which is incorporated herein by reference.

Another group of gemini surfactants which have been found to provide the low concentration emulsions of this invention are the cyclic cationic quaternary surfactants of the formula:

XIII

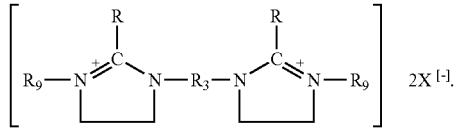

wherein R and $R_3$ are as identified hereinbefore in formula VII; $R_9$ is independently a $C_1$-$C_{10}$ alkyl or alkylaryl; and X represents a counterion such as an anion illustrated by halogen (C1, Br, and I), alkylsulfate such as methyl or ethylsulfate, alkylphosphate such as methylphosphate, and the like.

Preferably, the compounds used in the present invention comprise those of Formula XIII in which $R_3$ is a $C_2$-$C_4$ alkyl, most preferably ethyl, $R_9$ is a lower alkyl of from 1 to about 4 carbon atoms, most preferably methyl; and X is halogen or methylsulfate.

The compounds of Formula XIII can be prepared by a variety of snythetic routes though it has been found that they can be produced particularly effectively by quaternizing a bisimidazoline prepared by a process disclosed and claimed in copending application "Amphoteric Surfactants having Multiple Hydrophobic and Hydrophilic Groups", U.S. Ser. No. 08/292,993 filed Aug. 19, 1994 wherein a polyamine reactant having at least four amino groups, of which two are terminal primary amine groups, is reacted with an acylating agent such as a carboxylic acid, ester, and the naturally occurring triglyceride esters thereof or acid chlorides thereof in an amount sufficient to provide at least about 1.8 fatty acid groups $[R_1C(O)—]$ per polyamine to provide the bisimidazoline.

Also included in the gemini surfactants useful in this invention are those of the formula:

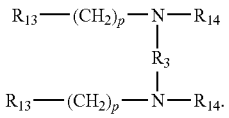

XIV wherein $R_{13}$ is a sugar moiety, e.g., a monosaccharide, disaccharide, or polysaccharide such as glucose; or a polyhydroxy compound such as glycerol; p is independently 0 to 4; $R_3$ is as defined above in formula VII; and $R_{14}$ is a $C_1$-$C_{22}$ alkyl or —C(O)$R_4$ wherein $R_4$ is as described above.

Some of the compounds such as those described above are set forth more fully in U.S. Pat. No. 5,534,197 which description is incorporated herein by reference.

In the compounds used in the invention, many of the moieties can be derived from natural sources which will generally contain mixtures of different saturated and unsaturated carbon chain lengths. The natural sources can be illustrated by coconut oil or similar natural oil sources such as palm kernel oil, palm oil, osya oil, rapeseed oil, castor oil or animal fat sources such as herring oil and beef tallow. Generally, the fatty acids from natural sources in the form of the fatty acid or the triglyceride oil can be a mixture of alkyl radicals containing from about 5 to about 22 carbon atoms. Illustrative of the natural fatty acids are caprylic ($C_8$), capric ($C_{10}$), lauric ($C_{12}$), myristic ($C_{14}$), palmitic ($C_{16}$), stearic ($C_{18}$), oleic ($C_{18}$, monounsaturated), linoleic ($C_{18}$, diunsaturated), linolenic ($C_{18}$, triunsaturated), ricinoleic ($C_{18}$, monounsaturated) arachidic ($C_{20}$), gadolic ($C_{20}$, monounsaturated), behenic ($C_{22}$) and erucic ($C_{22}$). These fatty acids can be used per se, as concentrated cuts or as fractionations of natural source acids. The fatty acids with even numbered carbon chain lengths are given as illustrative though the odd numbered fatty acids can also be used. In addition, single carboxylic acids, e.g., lauric acid, or other cuts, as suited for the particular application, may be used.

Where desired, the surfactants used in the present invention can be oxyalkylated by reacting the product with an alkylene oxide according to known methods, preferably in the presence of an alkaline catalyst. The free hydroxyl groups of the alkoxylated derivative can then be sulfated, phosphated or acylated using normal methods such as sulfation with sulfamic acid or sulfur trioxide-pyridine complex, or acylation with an acylating agent such as a carboxylic acid, ester, and the naturally occurring triglyceride esters thereof.

For alkylation conditions and commonly used alkylating agents, see Amphoteric Surfactants Vol. 12, Ed. B. R. Bluestein and C. L. Hilton, *Surfactant Science Series* 1982, pg. 17 and references cited therein, the disclosures of which are incorporated herein by reference.

For sulfation and phosphation, see Surfactant Science Series, Vol. 7, Part 1, S. Shore & D. Berger, page 135, the disclosure of which is incorporated herein by reference. For phosphating review, see Surfactant Science Series, Vol. 7, Part II, E. Jungermann & H. Silbertman, page 495, the disclosure of which is incorporated herein by reference.

The surfactant compositions of the invention are extremely effective in aqueous solution at low concentrations as defined herein. The surfactants of the invention can be used in any amount needed for a particular application which can be easily determined by a skilled artisan without undue experimentation.

IV. Auxiliary Detergent Ingredients

A. Detergency Builders

Compositions of the present invention may include detergency builders selected from any of the conventional inorganic and organic water-soluble builder salts, including neutral or alkaline salts, as well as various water-insoluble and so-called "seeded" builders.

Builders are preferably selected from the various water-soluble, alkali metal, ammonium or substituted ammonium phosphates, polyphosphates, phosphonates, polyphosphonates, carbonates, silicates, borates, polyhydroxysulfonates, polyacetates, carboxylates, and polycarboxylates. Most preferred are the alkali metal, especially sodium, salts of the above.

Specific examples of inorganic phosphate builders are sodium and potassium tripolyphosphate, pyrophosphate, polymeric metaphate having a degree of polymerization of from about 6 to 21, and orthophosphate. Examples of polyphosphonate builders are the sodium and potassium salts of ethylene-1,1-diphosphonic acid, the sodium and potassium salts of ethane 1-hydroxy-1,1-diphosphonic acid and the sodium and potassium salts of ethane, 1,1,2-triphosphonic acid.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

Water-soluble, nonphosphorus organic builders useful herein include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylenediamine tetraacetic acid, nitrilotriacetic acid, oxydisuccinic acid, mellitic acid, benzene polycarboxylic acids, and citric acid.

Highly preferred polycarboxylate builders herein are set forth in U.S. Pat. No. 3,308,067, Diehl, issued Mar. 7, 1967 incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other builders include the carboxylated carbohydrates of U.S. Pat. No. 3,723,322, Diehl incorporated herein by reference.

Other useful builders herein are sodium and potassium carboxymethyloxymalonate, carboxymethyloxysuccinate, cis-cyclohexanehexacarboxylate, cis-cyclopentanetetracarboxylate phloroglucinol trisulfonate, water-soluble polyacrylates (having molecular weights of from about 2,000 to about 200,000 for example), and the copolymers of maleic anhydride with vinyl methyl ether or ethylene.

Other suitable polycarboxylates for use herein are the polyacetal carboxylates described in U.S. Pat. No. 4,144,226, issued Mar. 13, 1979 to Crutchfield et al.; and U.S. Pat. No. 4,246,495, issued Mar. 27, 1979 to Crutchfield et al., both incorporated herein by reference.

"Insoluble" builders include both seeded builders such as 3:1 weight mixtures of sodium carbonate and calcium carbonate; and 2.7:1 weight mixtures of sodium sesquicarbonate and calcium carbonate. Amorphous and crystalline alumino silicates such as hydrated sodium Zeolite A are commonly used in laundry detergent applications. They have a particle size diameter of 0.1 micron to about 10 microns depending on water content of these molecules. These are referred to as ion exchange materials. Crystalline alumino silicates are characterized by their calcium ion exchange capacity. Amorphous alumino silicates are usually characterized by their magnesium exchange capacity. They can be naturally occurring or synthetically derived.

A detailed listing of suitable detergency builders can be found in U.S. Pat. No. 3,936,537, supra, incorporated herein by reference.

B. Miscellaneous Detergent Ingredients

Detergent composition components may also include hydrotropes, enzymes (e.g., proteases, amylases and cellulases), enzyme stabilizing agents, pH adjusting agents (monoethanolamine, sodium carbonate, etc.) halogen bleaches (e.g., sodium and potassium dichloroisocyanurates), peroxyacid bleaches (e.g., diperoxydodecane-1,12-dioic acid), inorganic percompound bleaches (e.g., sodium perborate), antioxidants as optional stabilizers, reductive agents, activators for percompound bleaches (e.g., tetraacetylethylenediamine and sodium nonanoyloxybenzene sulfonate), soil suspending agents (e.g., sodium carboxymethyl cellulose), soil anti-redisposition agents, corrosion inhibitors, perfumes and dyes, buffers, whitening agents, solvents (e.g., glycols and aliphatic alcohols) and optical brighteners. Any of other commonly used auxiliary additives such as inorganic salts and common salt, humectants, solubilizing agents, UV absorbers, softeners, chelating agents, static control agents and viscosity modifiers may be added to the detergent compositions of the invention.

For bar compositions, processing aids are optionally used such as salts and/or low molecular weight alcohols such as monodihydric, dihydric (glycol, etc.), trihydric (glycerol, etc.), and polyhydric (polyols) alcohols. Bar compositions may also include insoluble particulate material components, referred to as "fillers" such as calcium carbonate, silica and the like.

V. Composition Concentrations

The amount of the aminosilicone compound used in the laundry detergent compositions and methods of this invention will typically be sufficient to yield a concentration of aminosilicone compound in the washing medium of from about 0.001 to about 0.2 grams of aminosilicone compound per liter of washing medium, more typically from about 0.005 to about 0.1 g/L, and even more typically from about 0.01 to about 0.04 g/L.

In the compositions of the invention, the aminosilicone compound will typically be present in an amount of from about 0.005 to about 30% by weight, more typically from about 1 to about 10% by weight.

The compositions can be in any form that is convenient for use as a detergent, e.g. bars, powders, flakes, pastes, or liquids which may be aqueous or non-aqueous and structured or unstructured. The detergent compositions can be prepared in any manner which is convenient and appropriate to the desired physical form so as co-agglomeration, spray drying, or dispersing in a liquid.

The total weight percentages of the conventional surfactants of the present invention, all weight percentages being based on the total active weight of the compositions of this invention consisting of aminosilicone compound, optional carrier, conventional surfactant(s), gemini surfactant(s), soil release agent(s), and (optionally) detergency builder(s) are about 10 to about 99.9 weight percent, typically about 15-75 weight percent.

The gemini surfactants are typically present, if employed, at a level of about 0.005 to about 50, typically from about 0.02-15.0, active weight percent of the composition.

The total of the organophosphorus soil release agents and any secondary polymeric soil release agents, if employed, are typically present at a level of from about 0.05 to about 40, typically from about 0.2-15 active weight percent.

The optional detergency builders are suitably present at a level of from about 0 to about 70 weight percent, typically from about 5 to about 50 weight percent.

VI. Industrial Applicability

The compositions and methods of this invention can be used to clean various fabrics, e.g. wool, cotton, silk, polyesters, nylon, other synthetics, blends of multiple synthetics and or synthetic/natural fiber blends. The compositions and method are particularly useful with colored fabrics, i.e. those that have a visually perceptible hue. The compositions and methods are also particularly useful in connection with washing media that also contain a fragrance. The fragrance need not be pre-mixed or pre-reacted with the aminosilicone oil in any way nor must the fragrance as an active principle a hydroxy functional compound.

The fragrance substances that may be used in the context of the invention include natural and synthetic fragrances, perfumes, scents, and essences and any other substances and mixtures of liquids and/or powdery compositions which emit a fragrance. As the natural fragrances, there are those of animal origin, such as musk, civet, castreum, ambergris, or the like, and those of vegetable origin, such as lemon oil, rose oil, citronella oil, sandalwood oil, peppermint oil, cinnamon oil, or the like. As synthetic fragrances, there are mixed fragrances of alpha-pinene, limonene, geraniol, linalool, lavandulol, nerolidol, or the like.

VII. Soluble Powder Detergent Compositions Without Inorganic Phosphates

For a good implementation of the invention, said compositions comprise:

- from 5 to 60%, preferably from 8 to 40%, of their weight of at least one surface-active agent (S)
- from 5 to 80%, preferably from 8 to 40%, of their weight of at least one soluble inorganic or organic builder (B)
- from 0.01 to 8%, preferably from 0.1 to 5%, very particularly from 0.3 to 3%, of their weight of at least one aminosilicone (AS).

Mention may be made, among surface-active agents, of the anionic or non-ionic surface-active agents commonly used in the field of detergents for washing laundry.

Anionic Surface-Active Agents:

Typical anionic surface active agents include the following.

Alkyl ester sulphonates of formula R—CH($SO_3$M)—COOR', where R represents a $C_{8-20}$, preferably $C_{10}$-$C_{16}$, alkyl radical, R' a $C_1$-$C_6$, preferably $C_1$-$C_3$, alkyl radical and M an alkali metal (sodium, potassium or lithium) cation, a substituted or unsubstituted ammonium (methyl-, dimethyl-, trimethyl- or tetramethylammonium, dimethylpiperidinium, and the like) cation or a cation derived from an alkanolamine (monoethanolamine, diethanolamine, triethanolamine, and the like).

Alkyl sulphates of formula R$OSO_3$M, where R represents a $C_5$-$C_{24}$, preferably $C_{10}$-$C_{18}$, alkyl or hydroxyalkyl radical, M representing a hydrogen atom or a cation with the same definition as above, and their ethoxylated (EO) and/or propoxylated (PO) derivatives exhibiting an average of 0.5 to 30, preferably of 0.5 to 10, EO and/or PO units.

Alkylamide sulphates of formula RCONHR'$OSO_3$M, where R represents a $C_2$-$C_{22}$, preferably $C_6$-$C_{20}$, alkyl radical, R' a $C_2$-$C_3$ alkyl radical, M representing a hydrogen atom or a cation with the same definition as above, and their ethoxylated (EO) and/or propoxylated (PO) derivatives exhibiting an average of 0.5 to 60 EO and/or PO units.

Salts of $C_8$-$C_{24}$, preferably $C_{14}$-$C_{20}$, saturated or unsaturated fatty acids, $C_9$-$C_{20}$ alkylbenzenesulphonates, primary or secondary $C_8$-$C_{22}$ alkylsulphonates, alkylglycerol sulphonates, the sulphonated polycarboxylic acids described in GB-A-1,082,179, paraffin sulphonates, N-acyl-N-alkyltaurates, alkyl phosphates, isethionates, alkylsuccinamates, alkylsulphosuccinates, the monoesters or diesters of sulphosuccinates, N-acylsarcosinates, alkylglycoside sulphates or polyethoxycarboxylates the cation being an alkali metal (sodium, potassium or lithium), a substituted or unsubstituted ammonium residue (methyl-, dimethyl-, trimethyl- or tetramethylammonium, dimethylpiperidinium, and the like), or a residue derived from an alkanolamine (monoethanolamine, diethanolamine, triethanolamine, and the like).

Sophorolipids, such as those in acid or lactone form, derivatives of 17-hydroxyoctadecenic acid; and the like.

Non-ionic Surface-Active Agents

Typical non-ionic surface active agents include the following.

Polyoxyalkylenated (polyoxyethylenated, polyoxypropylenated or polyoxybutylenated)alkylphenols, the alkyl substituent of which is $C_6$-$C_{12}$, containing from 5 to 25 oxyalkylene units; mention may be made, by way of example, of TRITON X-45, X-114, X-100 or X-102, sold by Rohm & Haas Co., or IGEPAL NP2 to NP17 from Rhodia.

Polyoxyalkylenated $C_8$-$C_{22}$ aliphatic alcohols containing from 1 to 25 oxyalkylene (oxyethylene or oxypropylene) units; mention may be made, by way of example, of TTERGITOL 15-S-9 or TERGITOL 24-L-6 NMW, sold by Union Carbide Corp., NEODOL 45-9, NEODOL 23-65, NEODOL 45-7 or NEODOL 45-4, sold by Shell Chemical Co., KYRO EOB, sold by The Procter & Gamble Co., SYNPERONIC A3 to A9 from ICI, or RHODASURF IT, DB and B from Rhodia.

The products resulting from the condensation of ethylene oxide or of propylene oxide with propylene glycol or ethylene glycol, with a weight-average molecular mass of the order of 2000 to 10,000, such as the PLURONICS sold by BASF.

The products resulting from the condensation of ethylene oxide or of propylene oxide with ethylenediamine, such as the TETRONICS sold by BASF.

Ethoxylated and/or propoxylated $C_8$-$C_{18}$ fatty acids containing from 5 to 25 oxyethylene and/or oxypropylene units.

$C_8$-$C_{20}$ fatty acid amides containing from 5 to 30 oxyethylene units.

Ethoxylated amines containing from 5 to 30 oxyethylene units.

Alkoxylated amidoamines containing from 1 to 50, preferably from 1 to 25, very particularly from 2 to 20, oxyalkylene units (preferably oxyethylene units).

Amine oxides, such as ($C_{10}$-$C_{18}$ alkyl)dimethylamine oxides or ($C_8$-$C_{22}$ alkoxy)ethyldihydroxyethylamine oxides.

Alkoxylated terpene hydrocarbons, such as ethoxylated and/or propoxylated a- or b-pinenes, containing from 1 to 30 oxyethylene and/or oxypropylene units.

The alkylpolyglycosides which can be obtained by condensation (for example by acid catalysis) of glucose with primary fatty alcohols (U.S. Pat. No. 3,598,865, U.S. Pat. No. 4,565,647, EP-A-132,043, EP-A-132,046, and the like) exhibiting a $C_4$-$C_{20}$, preferably $C_8$-$C_{18}$, alkyl group and a mean number of glucose units of the order of 0.5 to 3, preferably of the order of 1.1 to 1.8, per mole of alkylpolyglycoside (APG); mention may in particular be made of those exhibiting:

- a $C_8$-$C_{14}$ alkyl group and, on average, 1.4 glucose units per mole
- a $C_{12}$-$C_{14}$ alkyl group and, on average, 1.4 glucose units per mole
- a $C_8$-$C_{14}$ alkyl group and, on average, 1.5 glucose units per mole
- a $C_8$-$C_{10}$ alkyl group and, on average, 1.6 glucose units per mole sold respectively under the names GLUCOPON 600 EC®, GLUCOPON 600 CSUP®, GLUCOPON 650 EC® and GLUCOPON 225 CSUP® by Henkel.

Mention may particularly be made, among soluble inorganic builders (B), of:

- amorphous or crystalline alkali metal silicates of formula $xSiO_2.M_2O.yH_2O$, with $1 \leqq x \leqq 3.5$ and $0 \leqq y/(x+1+y) \leqq 0.5$, where M is an alkali metal and very particularly sodium, including lamellar alkali metal silicates, such as those described in U.S. Pat. No. 4,664,839;
- alkaline carbonates (bicarbonates, sesquicarbonates);
- cogranules of hydrated alkali metal silicates and of alkali metal carbonates (sodium or potassium) which are rich in silicon atoms in the Q2 or Q3 form, described in EP-A-488,868; and
- tetraborates or borate precursors.

Mention may particularly be made, among soluble organic builders (B), of:

- water-soluble polyphosphonates (ethane-1-hydroxy-1,1-diphosphonates, salts of methylenediphosphonates, and the like);
- water-soluble salts of carboxyl polymers or copolymers, such as the water-soluble salts of polycarboxylic acids with a molecular mass of the order of 2000 to 100,000 obtained by polymerization or copolymerization of ethylenically unsaturated carboxylic acids, such as acrylic acid, maleic acid or anhydride, fumaric acid, itaconic acid, mesaconic acid, citraconic acid or methylenemalonic acid, and very particularly polyacrylates with a molecular mass of the order of 2000 to 10,000 (U.S. Pat. No. 3,308,067) or copolymers of acrylic acid and of maleic anhydride with a molecular mass of the order of 5000 to 75,000 (EP-A-066,915);
- polycarboxylate ethers (oxydisuccinic acid and its salts, tartrate monosuccinic acid and its salts, tartrate disuccinic acid and its salts);
- hydroxypolycarboxylate ethers;
- citric acid and its salts, mellitic acid, succinic acid and their salts;
- salts of polyacetic acids (ethylenediaminetetraacetates, nitrilotriacetates, N-(2-hydroxyethyl)nitrilodiacetates);
- ($C_5$-$C_{20}$ alkyl)succinic acids and their salts (2-dodecenylsuccinates, laurylsuccinates, and the like);
- polyacetal carboxylic esters;
- polyaspartic acid, polyglutamic acid and their salts;
- polyimides derived from the polycondensation of aspartic acid and/or of glutamic acid;
- polycarboxymethylated derivatives of glutamic acid (such as N,N-bis(carboxymethyl)glutamic acid and its salts, in particular the sodium salt) or of other amino acids; and
- aminophosphonates, such as nitrilotris(methylenephosphonate)s.

For a good implementation of the invention, the aminosilicone (AS) can be chosen from the aminopolyorganosiloxanes (APS) comprising siloxane units of general formulae:

$$R^1_aB_bSiO_{(4-a-b)/2} \quad \text{(I)},$$

where a+b=3, with a =0, 1, 2 or 3 and b =0, 1, 2 or 3

$$R^1_cA_dSiO_{(4-c-d)/2} \quad \text{(II)},$$

where c+d=2, with c=0 or 1 and d=1 or 2

$$R^1_2SiO_{2/2} \quad \text{(III) and optionally}$$

$$R^1_eA_fSiO_{(4-e-f)/2} \quad \text{(IV)},$$

where e+f=0 or1,with e=0 or 1 and f=0 or 1 in which formulae, the $R^1$ symbols, which are identical or different, represent a saturated or unsaturated, linear or branched, aliphatic radical containing from 1 to 10 carbon atoms or a phenyl radical, optionally substituted by fluoro or cyano groups;

the A symbols, which are identical or different, represent a primary, secondary, tertiary or quaternized amino group bonded to the silicon via an SiC bond;

the B symbols, which are identical or different, represent an OH functional group;

an OR functional group, where R represents an alkyl group containing from 1 to 12 carbon atoms, preferably from 3 to 6 carbon atoms, very particularly 4 carbon atoms;

an OCOR' functional group, where R' represents an alkyl group containing from 1 to 12 carbon atoms, preferably 1 carbon atom; or the A symbol.

The aminopolyorganosiloxanes (APS) preferably comprise units of formula (I), (II), (III) and optionally (IV), where in the units of formula (I), a=1, 2 or 3 and b=0 or 1 and in the units of formula (II), c=1 and d=1.

The A symbol is preferably an amino group of formula $$—R^2—N(R^3)(R^4)$$

where the $R^2$ symbol represents an alkylene group containing from 2 to 6 carbon atoms, which group is optionally substituted or interrupted by one or more nitrogen or oxygen atoms, the $R^3$ and $R^4$ symbols, which are identical or different, represent

H, an alkyl or hydroxyalkyl group containing from 1 to 12 carbon atoms, preferably from 1 to 6 carbon atoms, an aminoalkyl group, preferably a primary aminoalkyl group, the alkyl group of which contains from 1 to 12 carbon atoms, preferably from 1 to 6 carbon atoms, which group is optionally substituted and/or interrupted by at least one nitrogen and/or oxygen atom, the said amino group optionally being quaternized, for example by a hydrohalic acid or an alkyl or aryl halide.

Mention may particularly be made, as example of A symbol, of those of formulae:

| | |
|---|---|
| $—(CH_2)_3NH_2$; | $—(CH_2)_3NH_3^+X^-$; |
| $—(CH_2)_3N(CH_3)_2$; | $—(CH_2)_3N^+(CH_3)_2(C_{18}H_{37})X^-$; |
| $—(CH_2)_3NHCH_2CH_2NH_2$; | $—(CH_2)_3N(CH_2CH_2OH)_2$; and |
| $—(CH_2)_3N(CH_2CH_2NH_2)_2$. | |

Among these, the preferred formulae are:

$—(CH_2)_3NH_2$ $—(CH_2)_3NHCH_2CH_2NH_2$ and $—(CH_2)_3N(CH_2CH_2NH_2)_2$.

The $R^1$ symbol preferably represents methyl, ethyl, vinyl, phenyl, trifluoropropyl or cyanopropyl groups. It very particularly represents the methyl group (at least predominantly).

The B symbol preferably represents an OR group where R contains from 1 to 6 carbon atoms, very particularly 4 carbon atoms, or the A symbol. The B symbol is very preferably a methyl or butoxy group.

The aminosilicone is preferably at least substantially linear. It is very preferably linear, that is to say does not contain units of formula (IV). It can exhibit a number-average molecular mass of the order of 2000 to 50,000, preferably of the order of 3000 to 30,000.

For a good implementation of the invention, the aminosilicones (AS) or the aminopolyorganosiloxanes (APS) can exhibit in their chain, per total of 100 silicon atoms, from 0.1 to 50, preferably from 0.3 to 10, very particularly from 0.5 to 5, aminofunctionalized silicon atoms.

Insoluble inorganic builders can additionally be present but in a limited amount, in order not to exceed the level of less than 20% of insoluble inorganic material defined above.

Mention may be made, among these adjuvants, of crystalline or amorphous aluminosilicates of alkali metals (sodium or potassium) or of ammonium, such as zeolites A, P, X, and the like.

The detergent compositions can additionally comprise standard additives for powder detergent compositions. Typical such additional ingredients are as follows.

Additional Secondary Soil Release Agents

In addition to the organophosphate material provided as a soil release agent, secondary soil release agents may be provided in amounts of the order of 0.01-10%, preferably of the order of 0.1 to 5% and very particularly of the order of 0.2-3% by weight. Typical such agents include any of the following:

cellulose derivatives, such as cellulose hydroxyethers, methylcellulose, ethylcellulose, hydroxypropyl methylcellulose or hydroxybutyl methylcellulose;

poly(vinyl ester)s grafted onto polyalkylene stems, such as poly(vinyl acetate)s grafted onto polyoxyethylene stems (EP-A-219,048);

poly(vinyl alcohol)s;

polyester copolymers based on ethylene terephthalate and/or propylene terephthalate and polyoxyethylene terephthalate units, with an ethylene terephthalate and/or propylene terephthalate (number of units)/polyoxyethylene terephthalate (number of units) molar ratio of the order of 1/10 to 10/1, preferably of the order of 1/1 to 9/1, the polyoxyethylene terephthalates exhibiting polyoxyethylene units having a molecular weight of the order of 300 to 5000, preferably of the order of 600 to 5000 (U.S. Pat. No. 3,959,230, U.S. Pat. No. 3,893,929, U.S. Pat. No. 4,116,896, U.S. Pat. No. 4,702,857 and U.S. Pat. No. 4,770,666);

sulphonated polyester oligomers, obtained by sulphonation of an oligomer derived from ethoxylated allyl alcohol, from dimethyl terephthalate and from 1,2-propanediol, exhibiting from 1 to 4 sulphonate groups (U.S. Pat. No. 4,968,451);

polyester copolymers based on propylene terephthalate and polyoxyethylene terephthalate units which are optionally sulphonated or carboxylated and terminated by ethyl or methyl units (U.S. Pat. No. 4,711,730) or optionally sulphonated polyester oligomers terminated by alkylpolyethoxy groups (U.S. Pat. No. 4,702,857) or anionic sulphopolyethoxy (U.S. Pat. No. 4,721,580) or sulphoaroyl (U.S. Pat. No. 4,877,896) groups;

sulphonated polyesters with a molecular mass of less than 20,000, obtained from a diester of terephthalic acid, isophthalic acid, a diester of sulphoisophthalic acid and a diol, in particular ethylene glycol (WO 95/32997);

polyesterpolyurethanes obtained by reaction of a polyester with a number-average molecular mass of 300 to 4000, obtained from adipic acid and/or terephthalic acid and/or sulphoisophthalic acid and a diol, with a prepolymer containing end isocyanate groups obtained from a poly (ethylene glycol) with a molecular mass of 600-4000 and a diisocyanate (FR-A-2,334,698).

Other secondary soil release agents are disclosed as "non-cotton soil release agents" in WO 97/42288, incorporated herein by reference. For example, a group of such agents secondary soil release agent comprises: a sulfonated oligomeric ester composition comprising the sulfonated product of a pre-formed, substantially linear ester oligomer, said linear ester oligomer comprising, per mole, a) 2 moles of terminal units wherein from 1 mole to 2 moles of said terminal units are derived from an olefinically unsaturated component selected from the group consisting of allyl alcohol and medially] alcohol, and any remaining of said terminal units are other units of said linear ester oligomer; b) from 1 mole to 4 moles of nonionic hydrophile units, said hydrophile units being derived from alkyleneoxides, said alkylene oxides comprising from 50% to 100% ethylene oxide; c) from 1.1 moles to 20 moles of repeat units derived from an aryldicarbonyl component wherein said aryidicarbonyl component is comprised of from 50% to 100% dimethylterephthalate, whereby the repeat units derived from said dimethylterephthalate are terephthaloyl; and d) from 0.1 moles to 19 moles of repeat units derived from a diol component selected from the group consisting of C2-C4 glycols; wherein the extent of sulfonation of said sulfonated oligomeric ester composition is such that said terminal units are chemically modified by e) from 1 mole to 4 moles of terminal unit substituent groups of formula —$SO_xM$ wherein x is 2 or 3, said terminal unit substituent groups being derived from a bisulfite component selected from the group consisting of HSO3M wherein M is a conventional water-soluble cation.

Another class of non-cotton soil release agent comprises: A) at least 10% by weight of a substantially linear sulfonated poly-ethoxy/propoxy end-capped ester having molecular weight ranging from 500 to 8,000; said ester consisting essentially of on a molar basis: i) from 1 to 2 moles of sulfonated poly ethoxy/propoxy end-capping units of the formula: $(MS03)(CH_2)_m(CH2CH_2O)(RO)_n$— wherein M is a salt-forming cation such as sodium of tertraalkylammonium, m is 0 or 1, R is ethylene, propylene, and mixtures thereof; and n is fro 0 to 2; and mixtures thereof; ii) from 0.5 to 66 moles of units selected from the group consisting of: a) oxyethyleneoxy units; b) a mixture of oxyethyleneoxy and oxy-1,2,-propyleneoxy units wherein said oxyethyleneoxy units are present in an oxyethyleneoxy of oxy-1,2-propyleneoxy mole ratio ranging from 0.5:1 to 10:1; and c) a mixture of a) or b) with poly(oxyethylene)oxy units have a degree of polymerization of from 2 to 4; provided that when said poly(oxyethylene)oxy units have a degree of polymerization of 2, the mole ratio of poly(oxyethylene)oxy units to total group ii) units ranges fro 0:1 to 0.33:1; and when said poly(oxyethylene)oxy units have a degree of polymerization of 3; the mole ration of poly(oxyethylene)oxy units to total group ii) units ranges from 0:1 to 0.22:1; and when said poly(oxyethylene) oxy units have a degree of polymerization equal to 4, the mole ratio of poly(oxyethylene)oxy units to total group ii) units ranges from 0:1 to 0.14:1; iii) from 1.5 to 40 moles of terephthaloyl units; and iv) from 0 to 26 moles of 5-sulphophthaloyl units of the formula: —$(O)C(C_6H_3)(SO_3M)C(O)$— wherein M is a salt forming cation; and B) from 0.5% to 20% by weight of ester, of one or more crystallization-reducing stabilizers.

A typical non-cotton soil release agent comprise greater than 0.2% carboxy methyl cellulose.

Secondary Anti-Redeposition Agents

In addition to the organophosphate material provided as a soil release agent, and which may also assist as anti-redepositioning agents, secondary anti-redeposition agents may be provided in amounts of approximately 0.01-10% by weight for a powder detergent composition and of approximately 0.01-5% by weight for a liquid detergent composition. Typical such secondary anti-redeposition agents include any of the following:

ethoxylated monoamines or polyamines or ethoxylated amine polymers (U.S. Pat. No. 4,597,898, EP-A-011, 984);

carboxymethylcellulose;

sulphonated polyester oligomers obtained by condensation of isophthalic acid, dimethyl sulphosuccinate and diethylene glycol (FR-A-2,236,926); and polyvinylpyrrolidones.

Bleaching Agents

Bleaching agents may be provided in an amount of approximately 0.1-20%, preferably 1-10%, of the weight of the said powder detergent composition. Typical such agents include any of the following:

perborates, such as sodium perborate monohydrate or tetrahydrate;

peroxygenated compounds, such as sodium carbonate peroxohydrate, pyrophosphate peroxohydrate, urea hydrogen peroxide, sodium peroxide or sodium persulphate;

percarboxylic acids and their salts (known as "percarbonates"), such as magnesium monoperoxyphthalate hexahydrate, magnesium meta-chloroperbenzoate, 4-nonylamino-4-oxoperoxybutyric acid, 6-nonylamino-6-oxoperoxycaproic acid, diperoxydodecanedioic acid, peroxysuccinic acid nonylamide or decyldiperoxysuccinic acid, preferably in combination with a bleaching activator generating, in situ in the washing liquor, a peroxycarboxylic acid; mention may be made, among these activators, of tetraacetylethylenediamine, tetraacetylmethylenediamine, tetraacetylglycoluril, sodium p-acetoxybenzenesulphonate, pentacetylglucose, octaacetyllactose, and the like.

Fluorescence Agents

Fluorescence agents may be provided in an amount of approximately 0.05-1.2% by weight. Typical such agents include any derivatives of stilbene, pyrazoline, coumarin, fumaric acid, cinnamic acid, azoles, methinecyanines, thiophenes, and the like.

Foam-Supressant Agents

Foam-suppressant agents may be provided in amounts which can range up to 5% by weight. Typical such agents include any of the following:

$C_{10}$-$C_{24}$ fatty monocarboxylic acids or their alkali metal, ammonium or alkanolamine salts or fatty acid triglycerides;

saturated or unsaturated, aliphatic, alicyclic, aromatic or heterocyclic hydrocarbons, such as paraffins or waxes;

N-alkylaminotriazines;

monostearyl phosphates or monostearyl alcohol phosphates; and polyorganosiloxane oils or resins, optionally combined with silica particles;

Softeners

Softeners may be provided in amounts of approximately 0.5-10% by weight. Typical such agents are clays (smectites, such as montmorillonite, hectorite or saponite).

Enzymes

Enzymes may be provided in an amount which can range up to 5 mg by weight, preferably of the order of 0.05-3 mg, of active enzyme/g of detergent composition. Typical enzymes are proteases, amylases, lipases, cellulases or peroxydases (U.S. Pat. No. 3,553,139, U.S. Pat. No. 4,101,457, U.S. Pat. No. 4,507,219 and U.S. Pat. No. 4,261,868).

Other Additives

Typical other additives may be any of the following:

alcohols (methanol, ethanol, propanol, isopropanol, propanediol, ethylene glycol or glycerol);

buffer agents or fillers, such as sodium sulphate or alkaline earth metal carbonates or bicarbonates; and pigments, the amounts of optional insoluble inorganic additives having to be sufficiently limited in order not to exceed the level of less than 20% of insoluble inorganic materials defined above.

EXAMPLES

The present work shows tests of PEG, PPG, and Glycerine phosphate esters for soil-release from polyester, cotton, and polypropylene. Treatment either during the laundry process or a pretreatment is used to apply the material to the substrates. Two types of soil are used: dirty motor oil and cooked vegetable oil. Two pure surfactant systems are used as the laundry detergent: commercial SUN detergent (US) and a standard formulation from Rhodia (France). Untreated, REPEL-O-TEX SRP6-treated, and detergent-treated substrates are used as benchmarks.

Materials and Equipment Used

Tergetometers.

Soil Release Additives.

PEG400 Phosphate Ester, SUPER PHOS process.

PEG400/PPG425 (1:2) Phosphate Ester, P2O5 process, Co-phosphation of PPG and PEG PEG400/Glycerine Phosphate Ester, P2O5 process, Co-phosphation of glycerine and PEG

REPEL-O-TEX SRP6

Fabric Samples (Substrates)

Cotton: Style 400, LOT 519

Polyester: Spun Dacron, Type 54, Style 777, LOT 9778

Cotton/Polyester blend: Polypropylene Nonwoven

Soil (Stain)

dirty motor oil L-DMO 0.08% BW Solvent Violet Dye-13 in Soybean oil.

Surfactant Systems

Commercial detergent: SUN

Laundry Formula (LF): commercial detergent with SRP-6 (from CRA, France)

Equipment

Tergometer: A miniaturized reproduction of American-style washing machines composed 6 stainless steel containers onto which pulsated, variable-speed spinners have been adapted. The containers have been placed in a temperature-controlled water tank.

Spectrophotometer: Gardner TCS, to measure the amount of stain on swatch by colorimetry.

Protocols Used for Treatment, Soiling, and Washing

Two general types of treatment are used: 1) pretreatment of the substrates and 2) laundry-treatment by adding the soil-release additive to the detergent.

Example 1

Pretreatment

Test Protocols 4 drops of 33 wt % solution in water with NaOH, pH 6-7, of each phosphate ester (PEG400/PPG425 phosphate ester and PEG400/Glycerine phosphate ester) in a square Allow 5 minutes "dry time"

4 drops of soil added onto treated area of swatches (single knit cotton) (Note: Treated area is still wet!)

5 g polymer free detergent in 1 L of water in tergetometer

Swatches added to tergetometer vessels

104° F. wash cycle for 20 mins, 90° F. rinse for 5 minutes in 1 L fresh tap water (3 times)

Results

FIG. 1 shows the results for the pretreatment with 33 wt % solution of PEG400/PPG425 phosphate ester (soil added onto wet substrate) on cotton.

FIG. 1 shows photographs of un-treated/treated cotton swatches after soiling and washing/rinsing. In particular Part (a) shows an untreated, Dirty Motor Oil stained control sample cotton swatch.

Part (b) shows a Dirty Motor oil stained cotton swatch treated with PEG400/PPG425 phosphate ester. The PPG425 portion of the phosphate ester has a hydrophobically modified PEG400 chemistry. The ratio of PPG to PEG chains was 2:1 for this experiment.

Part (c) shows an untreated, Cooked Vegetable Oil stained control sample cotton swatch.

Part (d) shows a Cooked Vegetable Oil stained cotton swatch treated with PEG400/PPG425 phosphate ester, control. All soiled samples had been washed with SUN commercial detergent.

FIG. 1, parts a part c show untreated, soiled cotton swatches after washing/rinsing (here the soil is added onto the dry swatches). FIG. 1, parts b and d show treated cotton swatches after soiling and washing/rinsing. The pictures indicate the treated samples show soil-release compared to the untreated samples. However, as the cotton swatches had been still wet upon soiling, and thus, an adhesion of the hydrophobic soil onto the cotton fibers might had been prevented, it is difficult to draw conclusions from this test.

Example 2

Pretreatment

Test Protocol

1. Treatment: Cotton or polyester or PPNW samples add to treating solutions, stir for a few minutes then take off and remove excess of solutions and dry into oven at 60° C. for 60 min.

2. Pre-Wash: Add samples to 1 L top water at 104° F., and then add 5 g of SUN detergent. Wash 20 min. (some tests had been done without this pre-washing step: no difference observed), 3. Colorimetric measurement of treated samples with Gardner TSC.

4. Stain: Stir the oil stains for 30 minutes prior to use. After treatment add 4 drops of stain oil onto treated area of swatch, dry into oven at 60 C for 1 hr.

5. Wash: Add samples to 1 L tap water at 104° F., and then add 5 g of detergent. Wash 20 min.

6. Rinse 3 times—5 min in 1 L fresh tap water at 104° F.

7. Dry: for 60 min in oven at 60° C.

8. Colorimetric measurement of samples with Gardner TSC

Treating solutions:

2% PEG400PE, pH=6.26

2% REPEL-O-TEX SRP-6 (soil release polymer for polyester), pH=6.44

2% SUN detergent, pH=6.7 no treatment control

Tables 1 and 2, as well as part of Table 4, show the results of these tests.

TABLE 1

| Sample ID# | | 2% solution pretreatment, stain % Removal | | | |
|---|---|---|---|---|---|
| PEG400PE | Example 2 | PEG400PE | SRP-6 | untreated | Control |
| 1A | cotton (veg. oil) | 74.61 | 75.17 | 77.11 | 62.48 |
| 1B | cotton (motor oil) | 74.59 | 73.05 | 67.97 | 45.58 |
| 1C | polyester (veg. oil) | 17.84 | 88.09 | 21.00 | 5.24 |
| 1D | polyester (mot. oil) | 18.79 | 101.36 | 21.59 | 29.01 |

TABLE 2

| Sample ID# | | 2% solution pretreatment, no pre-wash % Removal | | |
|---|---|---|---|---|
| PEG400PE | Example 2 | PEG400PE | SRP-6 | Control |
| 2A | cotton (veg. oil) | 49.20 | 57.24 | 62.48 |
| 2B | cotton (motor oil) | 71.13 | 68.74 | 45.58 |
| 2C | polyester (veg. oil) | 9.59 | 77.74 | 5.24 |
| 2D | polyester (mot. oil) | 31.24 | 75.40 | 29.01 |

Example 3

Durability Test

Test Protocol 5-times pre-washing after treatment/before staining:

1. Treatment: Cotton or polyester or PPNW samples add to treating solutions, stir for a few minutes then take off and remove excess of solutions and dry into oven at 60° C. for 60 min.

2. Pre-Wash: Add samples to 1 L top water at 104° F., and then add 5 g of SUN detergent. Wash 20 min. (some tests had been done without this pre-washing step: no difference observed).

3. Rinse 3 times—5 min for each cycle in 1 L fresh tap water at 104° F.

4. Dry: for 60 min in oven at 60° C.

5. Repeat steps 2-4 four times.

6. Colorimetric measurement of samples with Gardner TSC. Gardner TSC is an industry standard instrument that measures color of any surface 7. Stain: Stir the oil stains for 30 minutes prior to use. After treatment add 4 drops of stain oil onto treated area of swatch, dry into oven at 60° C. for 1 hr.

8. Wash: Add samples to 1 L tap water at 104° F., and then add 5 g of detergent. Wash 20 min.

9. Rinse 3 times—5 min for each cycle in 1 L fresh tap water at 104° F.

10. Dry: for 60 min in oven at 60° C.

11. Colorimetric measurement of samples with Gardner TSC

Treating Solutions:

see above

TABLE 3

| Sample ID# | | 2% solution pretreatment, 5× rinse, stain % Removal | | | |
|---|---|---|---|---|---|
| PEG400PE | Example 3 | PEG400PE | SRP-6 | untreated | Control |
| 3A | cotton (veg. oil) | 79.33 | 74.40 | 82.48 | 62.48 |
| 3B | cotton (motor oil) | 80.07 | 78.14 | 83.86 | 45.58 |
| 3C | polyester (veg. oil) | 15.93 | 95.22 | 12.98 | 5.24 |
| 3D | polyester (mot. oil) | 22.79 | 87.17 | 23.86 | 29.01 |

TABLE 4

| Sample ID# | Example | Stain | 2% solution pretreatment, NWPP % Removal | |
|---|---|---|---|---|
| | | | PEG400PE | |
| 4A | 1 | veg. oil | 87.07 | no rinse after treatment |
| 4B | 1 | motor oil | 82.24 | |
| 4C | 2 | veg. oil | 81.05 | 5× rinse after treatment |
| 4D | 2 | motor oil | 64.22 | |
| | | | Pure SUN detergent | |
| 4E | 1 | veg. oil | 70.96 | no rinse after treatment |
| 4F | 1 | motor oil | 73.00 | |
| 4G | 2 | veg. oil | 71.66 | 5× rinse after treatment |
| 4H | 2 | motor oil | 69.93 | |

Example 4

Laundry-Treatment

Test Protocols

Use level was 0.4% PEG phosphate (acid form) in the Sun detergent as is, 5 g of this solution was used in each liter of wash.

Swatches added to tergetometer vessels

104° F. wash cycle for 20 mins, 90° F. rinse for 5 minutes in 1 L fresh tap water (3 times)

All experiments done on single knit cotton

Experiment was run with both PPG425/PEG 400 phosphate ester and glycerine/PEG 400 phosphate ester.

Stain was applied to dried (overnight in air on corrugated foil) swatches:

a) Dirty Motor Oil (DMO) on virgin swatches b) DMO on Pre-treated swatches c) Cooked Vegetable Oil (CVO) on virgin swatches d) CVO on Pre-treated swatches Wash method: Same as treatment method (0.4% phosphate ester in SUN detergent, 5 g of SUN-solution, 104° F. wash cycle for 20 mins, 90° F. rinse for 5 minutes (3 times)).

Results

Swatches of cotton, cotton/polyester blend, and polyester are treated (based on the standard laundry protocol, see above) with PEG400/PPG425 phosphate ester and PEG400/glycerine phosphate ester in SUN detergent. Swatches of polyester/cotton blend and polyester showed a slight resistance to re-soiling. Not enough swatches/replicates were used to obtain any other statistically significant conclusion. No effect is observed for cotton swatches.

Example 5

Laundry-Treatment

1. Pre-Wash: Prior to stain add untreated swatches 1 L of tap water at 104° F., and then add 5 g of polymer-added detergent. Wash 20 min 2. Rinse: 3 times for 5 min for each cycle in 1 L fresh tap water at 104° F.

3. Dry: for 60 min in oven at 60° C.

4. Colorimetric measurement of samples with Gardner TSC (see appendix).

5. Stain: Stir the oil stains for 30 minutes prior to use. Add 4 drops of stain oil onto swatch, dry into oven at 60° C. for 1 hr.

6. Wash: Add samples to 1 L tap water at 104° F., and then add 5 g of polymer-added detergent. Wash 20 min.

7. Rinse: 3 times—5 min for each cycle in 1 L fresh tap water at 104° F.

8. Dry: for 60 min in oven at 60° C.

9. Colorimetric measurement of samples with Gardner TSC (see appendix).

Polymer-added detergent: 1 wt % and 5 wt % of PEG400PE or SRP-6 added to SUN commercial detergent or LF commercial detergent.

Results

Tables 5-8 show the results for 1% and 5% additive in SUN or LF detergent compared to the pure SUN or LF detergent and to a control (untreated, non-prewashed swatch). The stain removal from cotton is in general better compared to polyester and no significant differences between the different samples are observed for cotton. For polyester only SRP6 shows improved stain removal. Especially for vegetable oil, the stain removal is significantly improved (approx. 90% removal vs. approx 20%). The PEG400PE sample shows no significant improvement compared to the pure detergent and the control samples. In general, the experiments using SUN detergent show better stain removal compared to LF, but the trends for the two different soil-release additives are the same for both.

Taking into account the limited accuracy of the measurements of % removal, we can conclude that no significant differences between PEG400PE, the pure detergents, and the control samples are observed. SRP6 performs better on polyester compared to PEG400PE.

TABLE 5

| | | 1% additive in SUN detergent % Removal | | | |
|---|---|---|---|---|---|
| Sample ID# | Example 5 | PEG400PE | SRP-6 | pure SUN | Control |
| 5A | cotton (veg. oil) | 86.89 | 87.66 | 89.40 | 62.48 |
| 5B | cotton (motor oil) | 82.36 | 86.28 | 92.18 | 45.58 |
| 5C | polyester (veg. oil) | 64.59 | 96.38 | 43.07 | 5.24 |
| 5D | polyester (mot. oil) | 58.19 | 80.83 | 38.73 | 29.01 |

TABLE 6

| | | 5% additive in SUN detergent % Removal | | | |
|---|---|---|---|---|---|
| Sample ID# | Example 5 | PEG400PE | SRP-6 | pure SUN | Control |
| 6A | cotton (veg. oil) | 85.34 | 82.36 | 75.95 | 62.48 |
| 6B | cotton (motor oil) | 89.90 | 89.24 | 88.02 | 45.58 |
| 6C | polyester (veg. oil) | 17.06 | 94.57 | 14.81 | 5.24 |
| 6D | polyester (mot. oil) | 101.67 | 91.31 | 36.68 | 29.01 |

TABLE 7

| | | 1% additive in LF % Removal | | | |
|---|---|---|---|---|---|
| Sample ID# | Example 5 | PEG400PE | SRP-6 | pure LF | Control |
| 7A | cotton (veg. oil) | 52.45 | 60.28 | 57.64 | 62.48 |
| 7B | cotton (motor oil) | 67.17 | 75.53 | 85.38 | 45.58 |
| 7C | polyester (veg. oil) | 7.45 | 57.23 | 6.68 | 5.24 |
| 7D | polyester (mot. oil) | 26.43 | 51.91 | 28.82 | 29.01 |

TABLE 8

| | | 5% additive in LF % Removal | | | |
|---|---|---|---|---|---|
| Sample ID# | Example 5 | PEG400PE | SRP-6 | pure LF | Control |
| 8A | cotton (veg. oil) | 59.01 | 54.81 | 62.60 | 62.48 |
| 8B | cotton (motor oil) | 77.99 | 70.15 | 77.19 | 45.58 |
| 8C | polyester (veg. oil) | 4.69 | 70.50 | 5.07 | 5.24 |
| 8D | polyester (mot. oil) | 30.26 | 65.14 | 26.22 | 29.01 |

Additional Information regarding the Examples is presented in Tables 9-12.

TABLE 9

| Sample ID# | Test Description | Staining Description | % Removal ΔΔ |
|---|---|---|---|
| | Pretreatment, soiling after treatment | | |
| 1A | 2% PEG400PE pH = 6.26 | cotton (veg. oil) | 74.61 |
| 1B | pretreating samples in 2% PEG400PE | cotton (motor oil) | 74.59 |

TABLE 9-continued

| Sample ID# | Test Description | Staining Description | % Removal ΔΔ |
|---|---|---|---|
| 1C | prewashing in SUN commercial detergent, then staining | polyester (veg. oil) | 17.84 |
| 1D | washing in SUN commercial detergent | polyester (mot. oil) | 18.79 |
| 1A | 2% SRP-6 pH = 6.6 | cotton (veg. oil) | 75.17 |
| 1B | pretreating samples in 2% SRP-6 | cotton (motor oil) | 73.05 |
| 1C | prewashing in SUN, then staining | polyester (veg. oil) | 88.09 |
| 1D | washing in SUN | polyester (mot. oil) | 101.36 |
| 1A | 2% SUN, Untreated | cotton (veg. oil) | 77.11 |
| 1B | pretreating samples in 2% SU | cotton (motor oil) | 67.97 |
| 1C | prewashing in SUN, then staining | polyester (veg. oil) | 21.00 |
| 1D | washing in SUN | polyester (mot. oil) | 21.59 |
| | Pretreatment, soiling after 5× rinses | | |
| 3A | 2% PEG400PE pH = 6.26 | cotton (veg. oil) | 79.33 |
| 3B | pretreating samples in 2% PEG400PE | cotton (motor oil) | 80.07 |
| 3C | prewashing in SUN (5-times), then staining | polyester (veg. oil) | 15.93 |
| 3D | washing in SUN | polyester (mot. oil) | 22.79 |
| 3A | 2% SRP-6 pH = 6.6 | cotton (veg. oil) | 74.40 |
| 3B | pretreating samples in 2% SRP-6, | cotton (motor oil) | 78.14 |
| 3C | prewashing in SUN (5-times), then staining | polyester (veg. oil) | 95.22 |
| 3D | washing in SUN | polyester (mot. oil) | 87.17 |
| 3A | 2% SUN, Untreated | cotton (veg. oil) | 82.48 |
| 3B | pretreating samples in 2% SUN, | cotton (motor oil) | 83.86 |
| 3C | prewashing in SUN (5-times), then staining, | polyester (veg. oil) | 12.98 |
| 3D | washing in SUN | polyester (mot. oil) | 23.86 |

TABLE 10

| | Laundry-Treatment SUN | | |
|---|---|---|---|
| 5A | 1% PEG400PE in SUN | cotton (veg. oil) | 86.89 |
| 5B | washing, staining, washing | cotton (motor oil) | 82.36 |
| 5C | | polyester (veg. oil) | 64.59 |
| 5D | | polyester (mot. oil) | 58.19 |
| 5A | 1% SRP-6 in SUN | cotton (veg. oil) | 87.66 |
| 5B | washing, staining, washing | cotton (motor oil) | 86.28 |
| 5C | | polyester (veg. oil) | 96.38 |
| 5D | | polyester (mot. oil) | 80.83 |
| 5A | pure SUN | cotton (veg. oil) | 89.40 |
| 5B | washing, staining, washing | cotton (motor oil) | 92.18 |
| 5C | | polyester (veg. oil) | 43.07 |
| 5D | | polyester (mot. oil) | 38.73 |
| 6A | 5% PEG400PE in SUN | cotton (veg. oil) | 85.34 |
| 6B | washing, staining, washing | cotton (motor oil) | 89.90 |
| 6C | | polyester (veg. oil) | 17.06 |
| 6D | | polyester (mot. oil) | 101.67 |
| 6A | 5% SRP-6 in SUN | cotton (veg. oil) | 82.36 |
| 6B | washing, staining, washing | cotton (motor oil) | 89.24 |
| 6C | | polyester (veg. oil) | 94.57 |
| 6D | | polyester (mot. oil) | 91.31 |
| 6A | pure SUN | cotton (veg. oil) | 75.95 |
| 6B | washing, staining, washing | cotton (motor oil) | 88.02 |
| 6C | | polyester (veg. oil) | 14.81 |
| 6D | | polyester (mot. oil) | 36.68 |

TABLE 11

| | Laundry-Treatment LF commercial detergent | | |
|---|---|---|---|
| 7A | 1% PEG400PE in Laundry Formulation (LF) | cotton (veg. oil) | 52.45 |
| 7B | washing, staining, washing | cotton (motor oil) | 67.17 |
| 7C | | polyester (veg. oil) | 7.45 |
| 7D | | polyester (mot. oil) | 26.43 |
| 7A | 1% SRP-6 in Laundry Formulation | cotton (veg. oil) | 60.28 |

TABLE 11-continued

| | Laundry-Treatment LF commercial detergent | | |
|---|---|---|---|
| 7B | washing, staining, washing | cotton (motor oil) | 75.53 |
| 7C | | polyester (veg. oil) | 57.23 |
| 7D | | polyester (mot. oil) | 51.91 |
| 7A | Laundry Formulation | cotton (veg. oil) | 57.64 |
| 7B | washing, staining, washing | cotton (motor oil) | 85.38 |
| 7C | | polyester (veg. oil) | 6.68 |
| 7D | | polyester (mot. oil) | 28.82 |
| 8A | 5% PEG400PE in Laundry Formulation | cotton (veg. oil) | 59.01 |
| 8B | washing, staining, washing | cotton (motor oil) | 77.99 |
| 8C | | polyester (veg. oil) | 4.69 |
| 8D | | polyester (mot. oil) | 30.26 |
| 8A | 5% SRP-6 in Laundry Formulation | cotton (veg. oil) | 54.81 |
| 8B | washing, staining, washing | cotton (motor oil) | 70.15 |
| 8C | | polyester (veg. oil) | 70.50 |
| 8D | | polyester (mot. oil) | 65.14 |
| 8A | Laundry Formulation (LF) | cotton (veg. oil) | 62.60 |
| 8B | washing, staining, washing | cotton (motor oil) | 77.19 |
| 8C | | polyester (veg. oil) | 5.07 |
| 8D | | polyester (mot. oil) | 26.22 |

TABLE 12

| | Treatment SUN | | |
|---|---|---|---|
| 4A | Treated NWPP* in 2% PEG400PE | veg. oil | 87.07 |
| 4B | prewashing in SUN, then staining, then washing | motor oil | 82.24 |
| 4C | Treated NWPP in 2% PEG400PE | veg. oil | 81.05 |
| 4D | prewashing in SUN commercial detergent (5-times), then staining, then washing | motor oil | 64.22 |
| 4E | NOT TREATED NWPP | veg. oil | 70.96 |

TABLE 12-continued

| | Treatment SUN | | |
|---|---|---|---|
| 4F | prewashing in SUN, then staining, then washing | motor oil | 73.00 |
| 4G | NOT TREATED NWPP | veg. oil | 71.66 |
| 4H | prewashing in SUN (5-times), then staining, then washing | motor oil | 69.93 |
| 2A | 2% PEG400PE pH = 6.26 | cotton (veg. oil) | 49.20 |
| 2B | pretreating samples in 2% PHG400PE, staining and then | cotton (motor oil) | 71.13 |
| 2C | washing in SUN | polyester (veg. oil) | 9.59 |
| 2D | | polyester (motor oil) | 31.24 |
| 2A | 2% SRP-6 pH = 6.6 | cotton (veg. oil) | 57.24 |
| 2B | pretreating samples in 2% SRP-6, staining and then | cotton (motor oil) | 68.74 |
| 2C | washing in SUN | polyester (veg. oil) | 77.74 |
| 2D | | polyester (motor oil) | 75.40 |
| 2A | CONTROL (untreated, non-prewashed) | cotton (veg. oil) | 62.48 |
| 2B | staining samples and then washing in SUN | cotton (motor oil) | 45.58 |
| 2C | | polyester (veg. oil) | 5.24 |
| 2D | | polyester (motor oil) | 29.01 |

*NWPP is Non-Woven PolyPropylene.

Calculation of % Removal

In the above example, % removal was calculated as follows.

White=sample pre-washed only

Before washing=sample pre-washed and stained

After washing =sample pre-washed, stained and then washed $$\Delta L = L_{after\ washing} - L_{before\ washing}$$

$$\Delta a = a_{after\ washing} - a_{before\ washing}$$

$$\Delta b = b_{after\ washing} - b_{before\ washing}$$

$$\Delta E = (\Delta L^2 + \Delta a^2 + \Delta b^2)^{1/2} = \text{EXPERIMENTAL DETERGENCE}$$

$$\Delta L' = L_{white} - L_{before\ washing}$$

$$\Delta a' = a_{white} - a_{before\ washing}$$

$$\Delta b' = b_{white} - b_{before\ washing}$$

$$\Delta E' = (\Delta L'^2 + \Delta a'^2 + \Delta b'^2)^{1/2} = \text{THEORETICAL DETERGENCE}$$

$$\%\ \text{REMOVAL} = (\text{Experimental Detergence}/\text{Theoretical Detergence}) \times 100\%$$

It should be apparent that embodiments other than those expressly discussed above come within the spirit and scope of the present invention. Thus, the present invention is not limited by the above description but is defined by the appended claims.

What is claimed is:

1. A detergent composition for cleaning a fabric article comprising:

(a) at least one detergent surfactant; and (b) at least one member selected from the group consisting of, a Gemini surfactant, a bleach, an activator for percompound bleach, a secondary soil release agent, a soil suspending agent, a secondary soil antiredeposition agent, a foam suppressant agent and a fabric softener;

(c)(I) a water-soluble or dispersible organophosphorus material selected from the group consisting of:

(c)(I)(1) organophosphorus compounds according to structure (I):

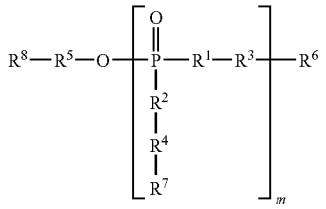

(I)

wherein:

each $R^1$ is and each $R^2$ is independently absent or O, provided that at least one of $R^1$ and $R^2$ is O, each $R^3$ is independently alkyleneoxy, poly(alkyleneoxy), which may optionally, be substituted on one or more carbon atom of such alkyleneoxy, or poly (alkyleneoxy) group by hydroxyl, alkyl, hydroxyalkyl, alkoxy, alkenyl, aryl, or aryloxy, $R^5$ is and each $R^4$ is independently absent or alkyleneoxy, poly(alkyleneoxy), which may optionally, be substituted on one or more carbon atom of such alkyleneoxy, or poly(alkyleneoxy) group by hydroxyl, alkyl, hydroxyalkyl, alkoxy, alkenyl, aryl, or aryloxy, $R^6$ and $R^8$ are each and each $R^7$ is independently H, or ($C_1$-$C_{30}$)hydrocarbon, which hydrocarbon may optionally be substituted on one or more carbon atoms by hydroxyl, fluorine, alkyl, alkenyl or aryl and/or interrupted at one or more sites by an O, N, or S heteroatom, or —$POR^9R^{10}$, $R^9$ and $R^{10}$ are each independently hydroxyl, alkoxy, aryloxy, or ($C_1$-$C_{30}$) hydrocarbon, which hydrocarbon may optionally be substituted on one or more carbon atoms by hydroxyl, fluorine, alkyl, alkenyl or aryl and/or interrupted at one or more sites by an O, N, or S heteroatom, and m is an integer of from 1 to 5, (b)(I)(2) salts of organophosphorus compounds according to structure (I), (b)(I)(3) condensation reaction products of two or more molecules of one or more organophosphorus compounds according to structure (I), and (b)(I)(4) mixtures comprising two or more of the compounds, salts, and/or reaction products of (b)(I)(1), (b)(I)(2), and (b)(I)(3);

provided that a 10% aqueous solution of said detergent composition has a pH of from about 4 to about 12 and, further comprising:

(b)(II) a vinyl alcohol material selected from the group consisting of:

(b)(II)(1) polymers comprising monomeric units according to structure (I-a):

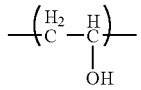

(I-a)

(b)(II)(2) salts of polymers (b)(II)(1), (b)(II)(3) reaction products of two or more molecules of one or more polymers (b)(II)(1), and (b)(II)(4) mixtures comprising two or more of the polymers, salts, and/or reaction products of(b)(II)(1), (b)(II)(2), and (b)(II)(3).

2. The composition of claim 1, comprising:

(a) at least 0.01 % to 95% by weight of said detergent surfactant. said detergent surfactant selected from the group consisting of anionic, nonionic, cationic, zwitterionic, and amphoteric surfactants, and mixtures thereof, (b) 0 to 30% by weight, of said bleach and from 0 to 10% by weight of said secondary soil release polymer having effective soil release on non-cotton fabric; and (c) from 0.01 to 10% by weight, said water-soluble or dispersible, organophosphorus soil release agent.

3. The composition of claim 1, comprising:

(a) at least 0.01 % to 95% by weight of said detergent surfactant, said detergent surfactant selected from the group consisting of anionic, nonionic, cationic, zwitterionic, and amphoteric surfactants, and mixtures thereof;

(b) from 1% to 5% of said secondary soil release polymer having effective soil release on non-cotton fabric and from 0 to 30% by weight, of said bleach;

(c) from 0.01 to 10% by weight, said water-soluble or dispersible, organophosphorus soil release agent.

4. The composition of claim 1, further comprising a member selected from the group consisting of builders, optical brighteners, bleach boosters, bleach activators, dye transfer agents, dispersants, enzymes, dyes, perfumes, colorants, filler salts, hydrotropes, and mixtures thereof.

5. The composition of claim 1, wherein the organophosphorus material represents from 0.01 to 10% of the weight of said composition.

6. The composition of claim 1, wherein the surface-active agent or agents represent from 0.005 to 60% of the weight of said composition.

7. The composition of claim 1, wherein the surface-active agent or agents represent from 0.5 to 40%, of the weight of said composition.

8. The composition according to claim 1, wherein the secondary soil release agent comprises a sulfonated oligomeric ester composition comprising the sulfonated product of a pre-formed, substantially linear ester oligomer, said linear ester oligomer comprising, per mole, a) 2 moles of terminal units wherein from 1 mole to 2 moles of said terminal units are derived from an olefinically unsaturated allyl alcohol, and any remaining of said terminal units are other units of said linear ester oligomer; b) from 1 mole to 4 moles of nonionic hydrophile units, said hydrophile units being derived from alkyleneoxides, said alkylene oxides comprising from 50% to 100% ethylene oxide; c) from 1.1 moles to 20 moles of repeat units derived from an aryldicarbonyl component wherein said aryldicarbonyl component is comprised of from 50% to 100% dimethylterephthalate, whereby the repeat units derived from said dimethylterephthalate are terephthaloyl; and d) from 0.1 moles to 19 moles of repeat units derived from a diol component selected from the group consisting of C2-C4 glycols; wherein the extent of sulfonation of said sulfonated oligomeric ester composition is such that said terminal units are chemically modified by e) from 1 mole to 4 moles of terminal unit substituent groups of formula —$SO_xM$ wherein x is 2 or 3, said terminal unit substituent groups being derived from a bisulfite component selected from the group consisting of HSO3M wherein M is a conventional water-soluble cation.

9. A method for cleaning a fabric article in a washing medium comprising:

applying an effective amount of a detergent composition of claim 1 to a fabric article in need of cleaning.

10. A method for providing soil release from cotton fabric, comprising contacting cotton fabric in need of cleaning with an effective amount of a laundry cleaning composition of claim 1.

* * * * *